US009540592B2

(12) United States Patent
Hulskotter et al.

(10) Patent No.: US 9,540,592 B2
(45) **Date of Patent: *Jan. 10, 2017**

(54) CLEANING COMPOSITIONS CONTAINING A POLYETHERAMINE, A SOIL RELEASE POLYMER, AND A CARBOXYMETHYLCELLULOSE

(71) Applicant: The Procter & Gamble Company, Cincinnati, OH (US)

(72) Inventors: Frank Hulskotter, Bad Duerkheim (DE); Stefano Scialla, Rome (IT); Brian Joseph Loughnane, Fairfield, OH (US); Alan Thomas Brooker, Newcastle upon Tyne (GB); Colin Ure, Tyne & Wear (GB); Sophia Rosa Ebert, Mannheim (DE); Bjoern Ludolph, Ludwigshafen (DE); Christof Wigbers, Mannheim (DE); Steffen Maas, Bubenheim (DE); Dieter Boeckh, Limburgerhof (DE); Christian Eidamshaus, Ludwigshafen (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/919,842

(22) Filed: Oct. 22, 2015

(65) Prior Publication Data

US 2016/0075970 A1 Mar. 17, 2016

Related U.S. Application Data

(63) Continuation of application No. 14/227,074, filed on Mar. 27, 2014, now Pat. No. 9,193,939.

(60) Provisional application No. 61/832,231, filed on Jun. 7, 2013, provisional application No. 61/806,231, filed on Mar. 28, 2013.

(51) Int. Cl.

| | |
|---|---|
| ***C11D 3/00*** | (2006.01) |
| ***C11D 3/30*** | (2006.01) |
| ***C11D 1/00*** | (2006.01) |
| ***C11D 1/44*** | (2006.01) |
| ***C11D 3/22*** | (2006.01) |
| ***C11D 3/37*** | (2006.01) |

(52) U.S. Cl.

CPC ..... *C11D 3/0036* (2013.01); *C11D 1/008* (2013.01); *C11D 1/44* (2013.01); *C11D 3/225* (2013.01); *C11D 3/30* (2013.01); *C11D 3/3707* (2013.01); *C11D 3/3715* (2013.01)

(58) Field of Classification Search

CPC ..... C11D 3/0036
USPC ..... 510/300
See application file for complete search history.

(56) References Cited

U.S. PATENT DOCUMENTS

| | | | | |
|---|---|---|---|---|
| 3,654,370 | A | 4/1972 | Yeakey et al. | |
| 3,862,227 | A * | 1/1975 | Haug | C08G 59/504 558/389 |
| 4,450,091 | A | 5/1984 | Schmolka | |
| 4,556,509 | A | 12/1985 | Demangeon et al. | |
| 4,609,683 | A | 9/1986 | Grigsby et al. | |
| 4,764,291 | A | 8/1988 | Steltenkamp et al. | |
| 4,820,436 | A | 4/1989 | Andree et al. | |
| 5,239,048 | A * | 8/1993 | Speranza | C07C 233/69 528/339.3 |
| 5,571,286 | A | 11/1996 | Connell et al. | |
| 5,863,886 | A | 1/1999 | Tracy et al. | |
| 5,948,744 | A | 9/1999 | Baillely et al. | |
| 6,146,427 | A | 11/2000 | Crutcher | |
| 6,172,021 | B1 | 1/2001 | Ofosu-Asante et al. | |
| 6,172,024 | B1 | 1/2001 | Arvanitidou | |
| 6,191,099 | B1 | 2/2001 | Crutcher | |
| 6,347,055 | B1 | 2/2002 | Motomura | |
| 6,365,561 | B1 | 4/2002 | Vinson et al. | |
| 6,369,024 | B1 | 4/2002 | Panandiker et al. | |
| 6,437,055 | B1 | 8/2002 | Moriarity et al. | |
| 6,506,716 | B1 | 1/2003 | Delplancke et al. | |
| 6,589,926 | B1 | 7/2003 | Vinson et al. | |
| 6,652,667 | B2 | 11/2003 | Ahmadi et al. | |
| 6,710,023 | B1 | 3/2004 | Bodet et al. | |
| 6,857,485 | B2 | 2/2005 | Patel et al. | |
| 6,951,710 | B2 | 10/2005 | Rieker et al. | |
| 7,037,883 | B2 | 5/2006 | Hsu et al. | |
| 7,387,992 | B2 | 6/2008 | Hsu et al. | |
| 7,696,385 | B2 | 4/2010 | Buehring et al. | |
| 7,816,481 | B2 | 10/2010 | Klein et al. | |
| 8,097,577 | B2 | 1/2012 | Danziger et al. | |

(Continued)

FOREIGN PATENT DOCUMENTS

| | | |
|---|---|---|
| DE | 1643426 A1 | 3/1979 |
| EP | 1664254 B9 | 8/2004 |

(Continued)

OTHER PUBLICATIONS

U.S. Appl. No. 62/042,351, filed Oct. 10, 2014, Rajan Keshav Panandiker, et al.
U.S. Appl. No. 62/042,354, filed Oct. 10, 2014, Rajan Keshav Panandiker, et al.
U.S. Appl. No. 62/042,360, filed Oct. 10, 2014, Rajan Keshav Panandiker, et al.
U.S. Appl. No. 62/042,372, filed Oct. 10, 2014, Renae Dianna Fossum, et al.
U.S. Appl. No. 62/042,470, filed Oct. 10, 2014, Rajan Keshav Panandiker, et al.

(Continued)

*Primary Examiner* — Nicole M Buie-Hatcher
*Assistant Examiner* — M. Reza Asdjodi
(74) *Attorney, Agent, or Firm* — Gregory S Darley-Emerson; Leonard W Lewis; Steven W Miller

(57) ABSTRACT

The present invention relates generally to cleaning compositions and, more specifically, to cleaning compositions containing a polyetheramine, a soil release polymer, and a carboxymethylceullulose, which is suitable for removal of stains from soiled materials.

19 Claims, No Drawings

(56) References Cited

U.S. PATENT DOCUMENTS

| | | | | |
|---|---|---|---|---|
| 8,193,144 | B2 * | 6/2012 | Tanner | C08G 65/22 106/401 |
| 8,247,368 | B2 | 8/2012 | Danziger et al. | |
| 8,471,065 | B2 | 6/2013 | Burton et al. | |
| 8,586,039 | B2 | 11/2013 | Tsuchiya et al. | |
| 8,815,007 | B2 | 8/2014 | Tanner et al. | |
| 2002/0016282 | A1 | 2/2002 | Kumar et al. | |
| 2002/0147368 | A1 | 10/2002 | Wei et al. | |
| 2005/0027141 | A1 | 2/2005 | Furushima et al. | |
| 2006/0074004 | A1 | 4/2006 | Johnson et al. | |
| 2009/0149369 | A1 * | 6/2009 | Tanner | C08G 65/22 510/405 |
| 2010/0267601 | A1 * | 10/2010 | Panandiker | C11D 3/2072 510/276 |
| 2010/0323943 | A1 | 12/2010 | Evers et al. | |
| 2011/0009670 | A1 | 1/2011 | Renken et al. | |
| 2012/0259075 | A1 | 10/2012 | Klein et al. | |
| 2012/0309884 | A1 | 12/2012 | Walker et al. | |
| 2013/0291315 | A1 | 11/2013 | Bennett et al. | |
| 2014/0255330 | A1 | 9/2014 | Cron et al. | |
| 2014/0296124 | A1 * | 10/2014 | Hulskotter | C11D 3/0036 510/300 |
| 2014/0296127 | A1 | 10/2014 | Hulskotter et al. | |
| 2015/0057212 | A1 | 2/2015 | Hulskotter et al. | |
| 2015/0275142 | A1 | 10/2015 | Hulskotter et al. | |
| 2015/0275143 | A1 | 10/2015 | Hulskotter et al. | |
| 2015/0275144 | A1 | 10/2015 | Hulskotter et al. | |

FOREIGN PATENT DOCUMENTS

| | | | | |
|---|---|---|---|---|
| EP | 1436374 B1 | | 8/2008 | |
| GB | 581994 | | 7/1943 | |
| GB | 581994 A | * | 10/1946 | |
| GB | 1129634 A | * | 10/1968 | C08G 69/34 |
| JP | 2011/0001504 | | 1/2011 | |
| WO | WO 86/07603 | | 12/1986 | |
| WO | WO 90/03423 | | 4/1990 | |
| WO | WO 97/30103 | | 8/1997 | |
| WO | WO 00/63334 | | 10/2000 | |
| WO | WO 01/27232 A1 | | 4/2001 | |
| WO | WO 01/76729 A2 | | 10/2001 | |
| WO | WO 2009/065738 A3 | | 9/2009 | |
| WO | WO 2012/126665 A1 | | 9/2012 | |

OTHER PUBLICATIONS

U.S. Appl. No. 62/055,214, filed Oct. 7, 2014, Brian Joseph Loughnane, et al.
U.S. Appl. No. 62/055,124, filed Oct. 10, 2014, Renae Dianna Fossum, et al.
U.S. Appl. No. 14/486,478, filed Oct. 9, 2014, Brian Joseph Loughnane, et al.
U.S. Appl. No. 14/496,577, filed Oct. 7, 2014, Brian Joseph Loughnane, et al.
U.S. Appl. No. 14/498,225, filed Oct. 13, 2014, Brian Joseph Loughnane, et al.
U.S. Appl. No. 14/496,131, filed Oct. 7, 2014, Frank Hulskotter, et al.
U.S. Appl. No. 14/496,151, filed Oct. 7, 2014, Brian Joseph Loughnane, et al.
International Search Report for PCT/US2014/031939, dated Jul. 7, 2014, containing 14 pages.
International Search Report for PCT/US2014/031941, dated Jul. 3, 2014, containing 14 pages.
The JEFFAMINE® Polytheramines, (HUNTSMAN), Enriching lives through innovation, Copyright 2007 (www.huntsman.com).

* cited by examiner

CLEANING COMPOSITIONS CONTAINING A POLYETHERAMINE, A SOIL RELEASE POLYMER, AND A CARBOXYMETHYLCELLULOSE

TECHNICAL FIELD

The present invention relates generally to cleaning compositions and, more specifically, to cleaning compositions containing a polyetheramine, a soil release polymer, and a carboxymethylceullulose, which is suitable for removal of stains from soiled materials.

BACKGROUND

Due to the increasing popularity of easy-care fabrics made of synthetic fibers as well as the ever increasing energy costs and growing ecological concerns of detergent users, the once popular warm and hot water washes have now taken a back seat to washing fabrics in cold water (30° C. and below). Many commercially available laundry detergents are even advertised as being suitable for washing fabrics at 15° C. or even 9° C. To achieve satisfactory washing results at such low temperatures, results comparable to those obtained with hot-water washes, the demands on low-temperature detergents are especially high.

It is known to include certain additives in detergent compositions to enhance the detergent power of conventional surfactants, so as to improve the removal of grease stains at temperatures of 30° C. and below. For example, laundry detergents containing an aliphatic amine compound, in addition to at least one synthetic anionic and/or nonionic surfactant, are known. Also, the use of linear, alkyl-modified (secondary) alkoxypropylamines in laundry detergents to improve cleaning at low temperatures is known. These known laundry detergents, however, are unable to achieve satisfactory cleaning at cold temperatures.

Furthermore, the use of linear, primary polyoxyalkyleneamines (e.g., Jeffamine® D-230) to stabilize fragrances in laundry detergents and provide longer lasting scent is also known. Also, the use of high-moleculer-weight (molecular weight of at least about 1000), branched, trifunctional, primary amines (e.g., Jeffamine® T-5000 polyetheramine) to suppress suds in liquid detergents is known. Additionally, an etheramine mixture containing a monoether diamine (e.g., at least 10% by weight of the etheramine mixture), methods for its production, and its use as a curing agent or as a raw material in the synthesis of polymers are known. Finally, the use of compounds derived from the reaction of diamines or polyamines with alkylene oxides and compounds derived from the reaction of amine terminated polyethers with epoxide functional compounds to suppress suds is known.

There is a continuing need for a detergent that exhibits improved cleaning performance at low wash temperatures, e.g., at 30° C. or even lower, without adversely affecting the production and the quality of the detergent in any way. More specifically, there is a need for a detergent composition that exhibits improved cold water grease cleaning, without adversely affecting particulate cleaning. Surprisingly, it has been found that compositions containing a polyetheramine, a soil release polymer, and a carboxymethylceullulose, provide both increased grease removal (particularly in cold water) and increased particulate cleaning.

SUMMARY

The present invention attempts to solve one more of the needs by providing, in one aspect of the invention, a cleaning composition (in liquid, powder, unit dose, pouch, or tablet forms) comprising from about 1% to about 70% by weight of a surfactant system, from about 0.01% to about 10.0% by weight of a soil release polymer, from about 0.1% to about 10% of a carboxymethylcellulose, and from about 0.1% to about 10% by weight of a polyetheramine of Formula (I), Formula (II), or a mixture thereof:

Formula (I)

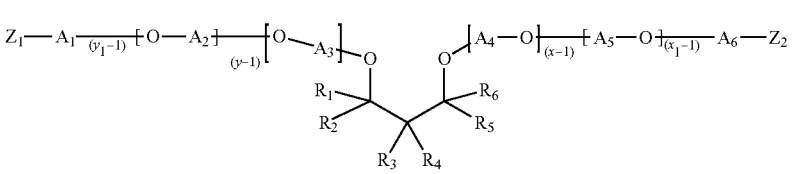

Formula (II)

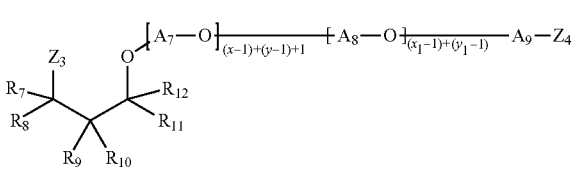

where each of $R_1$-$R_{12}$ is independently selected from H, alkyl, cycloalkyl, aryl, alkylaryl, or arylalkyl, where at least one of $R_1$-$R_6$ and at least one of $R_7$-$R_{12}$ is different from H, each of $A_1$-$A_9$ is independently selected from linear or branched alkylenes having 2 to 18 carbon atoms, each of $Z_1$-$Z_4$ is independently selected from OH or $NH_2$, where at least one of $Z_1$-$Z_2$ and at least one of $Z_3$-$Z_4$ is $NH_2$, where the sum of x+y is in the range of about 2 to about 200, where $x \geq 1$ and $y \geq 1$, and the sum of $x_1+y_1$ is in the range of about 2 to about 200, where $x_1 \geq 1$ and $y_1 \geq 1$. The cleaning compositions may further comprise one or more adjunct cleaning additives.

In another aspect, the invention relates to a cleaning composition comprising from about 1% to about 70% by weight of a surfactant system, from about 0.01% to about 10.0% by weight of a soil release polymer, from about 0.1% to about 10% of a carboxymethylcellulose, and from about 0.1% to about 10% by weight of a polyetheramine obtainable by:

a) reacting a 1,3-diol of formula (III) with a C2-C18 alkylene oxide to form an alkoxylated 1,3-diol, wherein the molar ratio of 1,3-diol to C2-C18 alkylene oxide is in the range of about 1:2 to about 1:10,

III

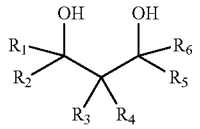

where $R_1$-$R_6$ are independently selected from H, alkyl, cycloalkyl, aryl, alkylaryl, or arylalkyl, where at least one of $R_1$-$R_6$ is different from H;

b) aminating the alkoxylated 1,3-diol with ammonia.

The present invention further relates to methods of cleaning soiled materials. Such methods include pretreatment of soiled material comprising contacting the soiled material with the cleaning compositions of the invention.

DETAILED DESCRIPTION

Features and benefits of the various embodiments of the present invention will become apparent from the following description, which includes examples of specific embodiments intended to give a broad representation of the invention. Various modifications will be apparent to those skilled in the art from this description and from practice of the invention. The scope is not intended to be limited to the particular forms disclosed and the invention covers all modifications, equivalents, and alternatives falling within the spirit and scope of the invention as defined by the claims.

As used herein, the articles including "the," "a" and "an" when used in a claim or in the specification, are understood to mean one or more of what is claimed or described.

As used herein, the terms "include," "includes" and "including" are meant to be non-limiting.

As used herein, the terms "substantially free of" or "substantially free from" mean that the indicated material is at the very minimum not deliberately added to the composition to form part of it, or, preferably, is not present at analytically detectable levels. It is meant to include compositions whereby the indicated material is present only as an impurity in one of the other materials deliberately included.

As used herein, the term "soiled material" is used non-specifically and may refer to any type of flexible material consisting of a network of natural or artificial fibers, including natural, artificial, and synthetic fibers, such as, but not limited to, cotton, linen, wool, polyester, nylon, silk, acrylic, and the like, as well as various blends and combinations. Soiled material may further refer to any type of hard surface, including natural, artificial, or synthetic surfaces, such as, but not limited to, tile, granite, grout, glass, composite, vinyl, hardwood, metal, cooking surfaces, plastic, and the like, as well as blends and combinations.

All cited patents and other documents are, in relevant part, incorporated by reference as if fully restated herein. The citation of any patent or other document is not an admission that the cited patent or other document is prior art with respect to the present invention.

In this description, all concentrations and ratios are on a weight basis of the cleaning composition unless otherwise specified.

Cleaning Composition

As used herein the phrase "cleaning composition" includes compositions and formulations designed for cleaning soiled material. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation. The cleaning compositions may have a form selected from liquid, powder, single-phase or multi-phase unit dose, pouch, tablet, gel, paste, bar, or flake.

Soil Release Polymer

The cleaning compositions described herein may include from about 0.01% to about 10.0%, typically from about 0.1% to about 5%, in some aspects from about 0.2% to about 3.0%, by weight of the composition, of a soil release polymer (also known as a polymeric soil release agents or "SRA").

Suitable soil release polymers typically have hydrophilic segments to hydrophilize the surface of hydrophobic fibers, such as polyester and nylon, and hydrophobic segments to deposit on hydrophobic fibers and remain adhered thereto through completion of washing and rinsing cycles, thereby serving as an anchor for the hydrophilic segments. This may enable stains occurring subsequent to treatment with a soil release agent to be more easily cleaned in later washing procedures.

Soil release agents may include a variety of charged, e.g., anionic or cationic (see, e.g., U.S. Pat. No. 4,956,447), as well as non-charged monomer units. The structure of the soil release agent may be linear, branched, or star-shaped. The soil release polymer may include a capping moiety, which is especially effective in controlling the molecular weight of the polymer or altering the physical or surface-active properties of the polymer. The structure and charge distribution of the soil release polymer may be tailored for application to different fibers or textile types and for formulation in different detergent or detergent additive products. Suitable polyester soil release polymers have a structure as defined by one of the following structures (III), (IV) or (V):

$$—[(OCHR^1—CHR^2)_a—O—OC—Ar—CO—]_d \quad (III)$$

$$—[(OCHR^3CHR^4)_b—O—OC\text{-}sAr—CO]_e \quad (IV)$$

$$—[(OCHR^5—CHR^6), OR^7]_f \quad (V)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is H, Na, Li, K, Mg+2, Ca+2, Al+3, ammonium, mono-, di-, tri-, or tetra-alkylammonium wherein the alkyl groups are C1-C18 alkyl or C2-C10 hydroxyalkyl, or any mixture thereof;

$R^1$, $R^2$, $R^3$, $R^4$, $R^5$ and $R^6$ are independently selected from H or C, —C18n- or iso-alkyl; and $R^7$ is a linear or branched C1-C18 alkyl, or a linear or branched C2-C30 alkenyl, or a cycloalkyl group with 5 to 9 carbon atoms, or a C6-C30 aryl group, or a C6-C30 arylalkyl group.

Suitable polyester soil release polymers are terephthalate polymers having the structure (III) or (IV) above. Other suitable soil release polymers may include, for example sulphonated and unsulphonated PET/POET polymers, both end-capped and non-end-capped. Examples of suitable polyester soil release polymers are the REPEL-O-TEX® line of polymers supplied by Rhodia, including REPEL-O-TEX® SRP6 and REPEL-O-TEX® SF-2. Other suitable soil release polymers include TexCare® polymers, including TexCare® SRA-100, TexCare® SRA-300, TexCare® SRN-100, TexCare® SRN-170, TexCare® SRN-240, TexCare® SRN-300, and TexCare® SRN-325, all supplied by Clariant. Especially useful soil release polymers are the sulphonated non-end-capped polyesters described in WO 95/32997A (Rhodia Chimie) Other suitable soil release polymers are Marloquest® polymers, such as Marloquest® SL supplied by Sasol. Examples of SRAs are described in U.S. Pat. Nos. 4,968,451; 4,711,730; 4,721,580; 4,702,857; 4,877,896; 3,959,230; 3,893,929; 4,000,093; 5,415,807; 4,201,824; 4,240,918; 4,525,524; 4,201,824; 4,579,681; and 4,787,989; European Patent Application 0 219 048; 279,134 A; 457,205 A; and DE 2,335,044; and WO201419792; WO2012104156/57/58, WO201419658; WO20141965; WO201429479.

Cellulosic Polymer

The cleaning compositions described herein may include from about 0.1% to about 10%, typically from about 0.5% to about 7%, in some aspects from about 3% to about 5%, by weight of the composition, of a cellulosic polymer.

Suitable cellulosic polymers include alkyl cellulose, alkylalkoxyalkyl cellulose, carboxyalkyl cellulose, and alkyl carboxyalkyl cellulose. In some aspects, the cellulosic polymer is selected from carboxymethyl cellulose, methyl cellulose, methyl hydroxyethyl cellulose, methyl carboxymethyl cellulose, or mixtures thereof. In certain aspects, the cellulosic polymer is a carboxymethyl cellulose having a degree of carboxymethyl substitution of from about 0.5 to about 0.9 and a molecular weight from about 100,000 Da to about 300,000 Da. Carboxymethylcellulose polymers include Finnfix® GDA (sold by CP Kelko), a hydrophobically modified carboxymethylcellulose, e.g., the alkyl ketene dimer derivative of carboxymethylcellulose sold under the tradename Finnfix® SH1 (CP Kelko), or the blocky carboxymethylcellulose sold under the tradename Finnfix®V (sold by CP Kelko).

Polyetheramines

The cleaning compositions described herein may include from about 0.1% to about 10%, in some examples, from about 0.2% to about 5%, and in other examples, from about 0.5% to about 3%, by weight the composition, of a polyetheramine.

In some aspects, the polyetheramine is represented by the structure of Formula (I):

Formula (I)

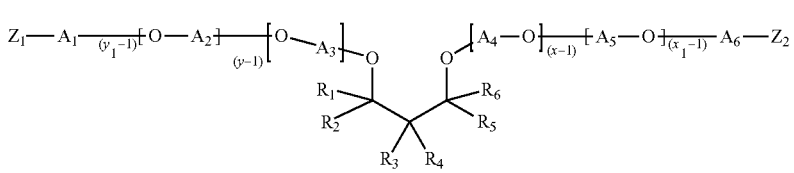

where each of $R_1$-$R_6$ is independently selected from H, alkyl, cycloalkyl, aryl, alkylaryl, or arylalkyl, where at least one of $R_1$-$R_6$ is different from H, typically at least one of $R_1$-$R_6$ is an alkyl group having 2 to 8 carbon atoms, each of $A_1$-$A_6$ is independently selected from linear or branched alkylenes having 2 to 18 carbon atoms, typically 2 to 10 carbon atoms, more typically, 2 to 5 carbon atoms, each of $Z_1$-$Z_2$ is independently selected from OH or $NH_2$, where at least one of $Z_1$-$Z_2$ is $NH_2$, typically each of $Z_1$ and $Z_2$ is $NH_2$, where the sum of x+y is in the range of about 2 to about 200, typically about 2 to about 20 or about 3 to about 20, more typically about 2 to about 10 or about 3 to about 8 or about 4 to about 6, where x≥1 and y≥1, and the sum of $x_1+y_1$ is in the range of about 2 to about 200, typically about 2 to about 20 or about 3 to about 20, more typically about 2 to about 10 or about 3 to about 8 or about 2 to about 4, where $x_1 \geq 1$ and $y_1 \geq 1$.

In some aspects, in the polyetheramine of Formula (I), each of $A_1$-$A_6$ is independently selected from ethylene, propylene, or butylene, typically each of $A_1$-$A_6$ is propylene. In certain aspects, in the polyetheramine of Formula (I), each of $R_1$, $R_2$, $R_5$, and $R_6$ is H and each of $R_3$ and $R_4$ is independently selected from C1-C16 alkyl or aryl, typically each of $R_1$, $R_2$, $R_5$, and $R_6$ is H and each of $R_3$ and $R_4$ is independently selected from a butyl group, an ethyl group, a methyl group, a propyl group, or a phenyl group. In some aspects, in the polyetheramine of Formula (I), $R_3$ is an ethyl group, each of $R_1$, $R_2$, $R_5$, and $R_6$ is H, and $R_4$ is a butyl group. In some aspects, in the polyetheramine of Formula (I), each of $R_1$ and $R_2$ is H and each of $R_3$, $R_4$, $R_5$, and $R_6$ is independently selected from an ethyl group, a methyl group, a propyl group, a butyl group, a phenyl group, or H.

In some aspects, the polyetheramine is represented by the structure of Formula (II):

Formula (II)

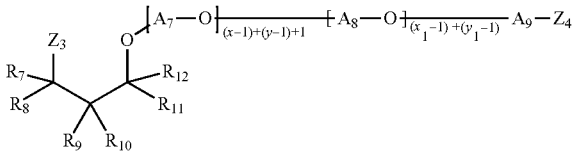

where each of $R_7$-$R_{12}$ is independently selected from H, alkyl, cycloalkyl, aryl, alkylaryl, or arylalkyl, where at least one of $R_7$-$R_{12}$ is different from H, typically at least one of $R_7$-$R_{12}$ is an alkyl group having 2 to 8 carbon atoms, each of $A_7$-$A_9$ is independently selected from linear or branched alkylenes having 2 to 18 carbon atoms, typically 2 to 10 carbon atoms, more typically, 2 to 5 carbon atoms, each of $Z_3$-$Z_4$ is independently selected from OH or $NH_2$, where at least one of $Z_3$-$Z_4$ is $NH_2$, typically each of $Z_3$ and $Z_4$ is $NH_2$, where the sum of x+y is in the range of about 2 to about 200, typically about 2 to about 20 or about 3 to about 20, more typically about 2 to about 10 or about 3 to about 8 or about 2 to about 4, where x≥1 and y≥1, and the sum of $x_1+y_1$ is in the range of about 2 to about 200, typically about 2 to about 20 or about 3 to about 20, more typically about 2 to about 10 or about 3 to about 8 or about 2 to about 4, where $x_1 \geq 1$ and $y_1 \geq 1$.

In some aspects, in the polyetheramine of Formula (II), each of $A_7$-$A_9$ is independently selected from ethylene, propylene, or butylene, typically each of $A_7$-$A_9$ is propylene. In certain aspects, in the polyetheramine of Formula (II), each of $R_7$, $R_8$, $R_{11}$, and $R_{12}$ is H and each of $R_9$ and $R_{10}$ is independently selected from C1-C16 alkyl or aryl, typically each of $R_7$, $R_8$, $R_{11}$, and $R_{12}$ is H and each of $R_9$ and $R_{10}$ is independently selected from a butyl group, an ethyl group, a methyl group, a propyl group, or a phenyl group. In some aspects, in the polyetheramine of Formula (II), $R_9$ is an ethyl group, each of $R_7$, $R_8$, $R_{11}$, and $R_{12}$ is H, and $R_{10}$ is a butyl group. In some aspects, in the polyetheramine of Formula (II), each of $R_7$ and $R_8$ is H and each of $R_9$, $R_{10}$, $R_{11}$, and $R_{12}$ is independently selected from an ethyl group, a methyl group, a propyl group, a butyl group, a phenyl group, or H.

In some aspects, x, $x_1$, y, and/or $y_1$ are independently equal to 3 or greater, meaning that the polyetheramine of Formula (I) may have more than one [$A_2$-O] group, more than one [$A_3$-O] group, more than one [$A_4$-O] group, and/or more than one [$A_5$-O] group. In some aspects, $A_2$ is selected from ethylene, propylene, butylene, or mixtures thereof. In some aspects, $A_3$ is selected from ethylene, propylene, butylene, or mixtures thereof. In some aspects, $A_4$ is selected from ethylene, propylene, butylene, or mixtures thereof. In some aspects, $A_5$ is selected from ethylene, propylene, butylene, or mixtures thereof.

Similarly, the polyetheramine of Formula (II) may have more than one [$A_7$-O] group and/or more than one [$A_8$-O] group. In some aspects, $A_7$ is selected from ethylene, propylene, butylene, or mixtures thereof. In some aspects, $A_8$ is selected from ethylene, propylene, butylene, or mixtures thereof.

In some aspects, [$A_2$-O] is selected from ethylene oxide, propylene oxide, butylene oxide, or mixtures thereof. In some aspects, [$A_3$-O] is selected from ethylene oxide, propylene oxide, butylene oxide, or mixtures thereof. In some aspects, [$A_4$-O] is selected from ethylene oxide, propylene oxide, butylene oxide, or mixtures thereof. In some aspects, [$A_5$-O] is selected from ethylene oxide, propylene oxide, butylene oxide, or mixtures thereof. In some aspects, [$A_7$-O] is selected from ethylene oxide, propylene oxide, butylene oxide, or mixtures thereof. In some aspects, [$A_8$-O] is selected from ethylene oxide, propylene oxide, butylene oxide, or mixtures thereof.

When $A_2$, $A_3$, $A_4$, and/or $A_5$ are mixtures of ethylene, propylene, and/or butylenes, the resulting alkoxylate may have a block-wise structure or a random structure. When $A_7$ and/or $A_8$ are mixtures of ethylene, propylene, and/or butylenes, the resulting alkoxylate may have a block-wise structure or a random structure.

For a non-limiting illustration, when x=7 in the polyetheramine according to Formula (I), then the polyetheramine comprises six [$A_4$-O] groups. If $A_4$ comprises a mixture of ethylene groups and propylene groups, then the resulting polyetheramine would comprise a mixture of ethoxy (EO) groups and propoxy (PO) groups. These groups may be arranged in a random structure (e.g., EO-EO-PO-EO-PO-PO) or a block-wise structure (EO-EO-EO-PO-PO-PO). In this illustrative example, there are an equal number of different alkoxy groups (here, three EO and three PO), but there may also be different numbers of each alkoxy group (e.g., five EO and one PO). Furthermore, when the polyetheramine comprises alkoxy groups in a block-wise structure, the polyetheramine may comprise two blocks, as shown in the illustrative example (where the three EO groups form one block and the three PO groups form another block), or the polyetheramine may comprise more than two blocks. The above discussion also applies to polyethermines according to Formula (II).

In certain aspects, the polyetheramine is selected from the group consisting of Formula B, Formula C, and mixtures thereof:

Formula B

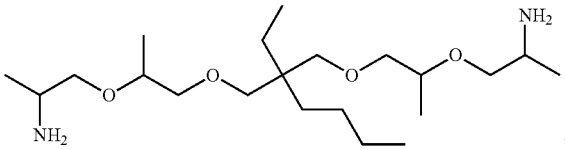

;

Formula C

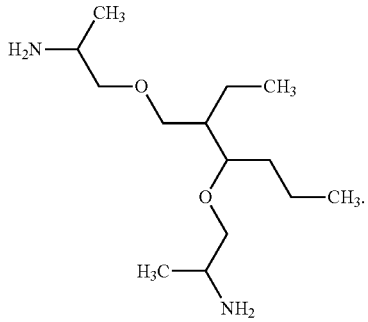

In some aspects, the polyetheramine comprises a mixture of the compound of Formula (I) and the compound of Formula (II).

Typically, the polyetheramine of Formula (I) or Formula (II) has a weight average molecular weight of about 290 to about 1000 grams/mole, typically, about 300 to about 700 grams/mole, even more typically about 300 to about 450 grams/mole. The molecular mass of a polymer differs from typical molecules in that polymerization reactions produce a distribution of molecular weights, which is summarized by the weight average molecular weight. The polyetheramine polymers of the invention are thus distributed over a range of molecular weights. Differences in the molecular weights are primarily attributable to differences in the number of monomer units that sequence together during synthesis. With regard to the polyetheramine polymers of the invention, the monomer units are the alkylene oxides that react with the 1,3-diols of formula (III) to form alkoxylated 1,3-diols, which are then aminated to form the resulting polyetheramine polymers. The resulting polyetheramine polymers are characterized by the sequence of alkylene oxide units. The alkoxylation reaction results in a distribution of sequences of alkylene oxide and, hence, a distribution of molecular weights. The alkoxylation reaction also produces unreacted alkylene oxide monomer ("unreacted monomers") that do not react during the reaction and remain in the composition.

In some aspects, the polyetheramine comprises a polyetheramine mixture comprising at least 90%, by weight of the polyetheramine mixture, of the polyetheramine of Formula (I), the polyetheramine of Formula (II), or a mixture thereof. In some aspects, the polyetheramine comprises a polyetheramine mixture comprising at least 95%, by weight of the polyetheramine mixture, of the polyetheramine of Formula (I), the polyetheramine of Formula (II), or a mixture thereof.

The polyetheramine of Formula (I) and/or the polyetheramine of Formula (II), are obtainable by:

a) reacting a 1,3-diol of formula (III) with a $C_2$-$C_{18}$ alkylene oxide to form an alkoxylated 1,3-diol, wherein the molar ratio of 1,3-diol to $C_2$-$C_{18}$ alkylene oxide is in the range of about 1:2 to about 1:10, (III)

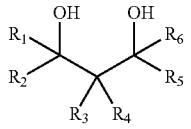

where $R_1$-$R_6$ are independently selected from H, alkyl, cycloalkyl, aryl, alkylaryl, or arylalkyl, where at least one of $R_1$-$R_6$ is different from H;

b) aminating the alkoxylated 1,3-diol with ammonia.

In some aspects, the molar ratio of 1,3-diol to $C_2$-$C_{18}$ alkylene oxide is in the range of about 1:3 to about 1:8, more typically in the range of about 1:4 to about 1:6. In certain aspects, the $C_2$-$C_{18}$ alkylene oxide is selected from ethylene oxide, propylene oxide, butylene oxide or a mixture thereof. In further aspects, the $C_2$-$C_{18}$ alkylene oxide is propylene oxide.

In some aspects, in the 1,3-diol of formula (III), $R_1$, $R_2$, $R_5$, and $R_6$ are H and $R_3$ and $R_4$ are $C_{1-16}$ alkyl or aryl. In further aspects, the 1,3-diol of formula (III) is selected from 2-butyl-2-ethyl-1,3-propanediol, 2-methyl-2-propyl-1,3-propanediol, 2-methyl-2-phenyl-1,3-propanediol, 2,2-dimethyl-1,3-propandiol, 2-ethyl-1,3-hexandiol, or a mixture thereof.

Step a): Alkoxylation

The 1,3-diols of Formula III are synthesized as described in WO10026030, WO10026066, WO09138387, WO09153193, and WO10010075. Suitable 1,3-diols include 2,2-dimethyl-1,3-propane diol, 2-butyl-2-ethyl-1,3-propane diol, 2-pentyl-2-propyl-1,3-propane diol, 2-(2-methyl)butyl-2-propyl-1,3-propane diol, 2,2,4-trimethyl-1,3-propane diol, 2,2-diethyl-1,3-propane diol, 2-methyl-2-propyl-1,3-propane diol, 2-ethyl-1,3-hexane diol, 2-phenyl-2-methyl-1,3-propane diol, 2-methyl-1,3-propane diol, 2-ethyl-2-methyl-1,3 propane diol, 2,2-dibutyl-1,3-propane diol, 2,2-di(2-methylpropyl)-1,3-propane diol, 2-isopropyl-2-methyl-1,3-propane diol, or a mixture thereof. In some aspects, the 1,3-diol is selected from 2-butyl-2-ethyl-1,3-propanediol, 2-methyl-2-propyl-1,3-propanediol, 2-methyl-2-phenyl-1,3-propanediol, or a mixture thereof. Typically used 1,3-diols are 2-butyl-2-ethyl-1,3-propanediol, 2-methyl-2-propyl-1,3-propanediol, 2-methyl-2-phenyl-1,3-propanediol.

An alkoxylated 1,3-diol may be obtained by reacting a 1,3-diol of Formula III with an alkylene oxide, according to any number of general alkoxylation procedures known in the art. Suitable alkylene oxides include $C_2$-$C_{18}$ alkylene oxides, such as ethylene oxide, propylene oxide, butylene oxide, pentene oxide, hexene oxide, decene oxide, dodecene oxide, or a mixture thereof. In some aspects, the $C_2$-$C_{18}$ alkylene oxide is selected from ethylene oxide, propylene oxide, butylene oxide, or a mixture thereof. A 1,3-diol may be reacted with a single alkylene oxide or combinations of two or more different alkylene oxides. When using two or more different alkylene oxides, the resulting polymer may be obtained as a block-wise structure or a random structure.

Typically, the molar ratio of 1,3-diol to $C_2$-$C_{18}$ alkylene oxide at which the alkoxylation reaction is carried out is in the range of about 1:2 to about 1:10, more typically about 1:3 to about 1:8, even more typically about 1:4 to about 1:6.

The alkoxylation reaction generally proceeds in the presence of a catalyst in an aqueous solution at a reaction temperature of from about 70° C. to about 200° C. and typically from about 80° C. to about 160° C. The reaction may proceed at a pressure of up to about 10 bar or up to about 8 bar. Examples of suitable catalysts include basic catalysts, such as alkali metal and alkaline earth metal hydroxides, e.g., sodium hydroxide, potassium hydroxide and calcium hydroxide, alkali metal alkoxides, in particular sodium and potassium $C_1$-$C_4$-alkoxides, e.g., sodium methoxide, sodium ethoxide and potassium tert-butoxide, alkali metal and alkaline earth metal hydrides, such as sodium hydride and calcium hydride, and alkali metal carbonates, such as sodium carbonate and potassium carbonate. In some aspects, the catalyst is an alkali metal hydroxides, typically potassium hydroxide or sodium hydroxide. Typical use amounts for the catalyst are from about 0.05 to about 10% by weight, in particular from about 0.1 to about 2% by weight, based on the total amount of 1,3-diol and alkylene oxide. During the alkoxylation reaction, certain impurities—unintended constituents of the polymer—may be formed, such as catalysts residues.

Alkoxylation with x+y $C_2$-$C_{18}$ alkylene oxides and/or $x_1$+$y_1$ $C_2$-$C_{18}$ alkylene oxides produces structures as represented by Formula IV and/or Formula V:

Formula (IV)

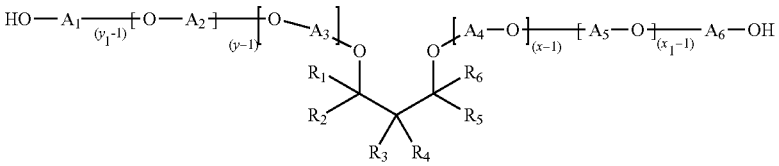

Formula (V)

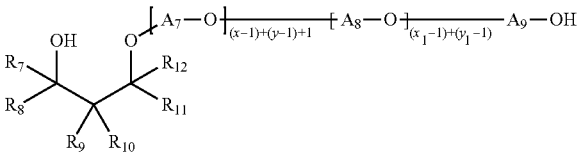

where $R_1$-$R_{12}$ are independently selected from H, alkyl, cycloalkyl, aryl, alkylaryl, or arylalkyl, where at least one of $R_1$-$R_6$ and at least one of $R_7$-$R_{12}$ is different from H, each of $A_1$-$A_9$ is independently selected from linear or branched alkylenes having 2 to 18 carbon atoms, typically 2 to 10 carbon atoms, more typically 2 to 5 carbon atoms, and the sum of x+y is in the range of about 2 to about 200, typically about 2 to about 20 or about 3 to about 20, more typically about 2 to about 10 or about 2 to about 5, where x≥1 and y≥1, and the sum of $x_1+y_1$ is in the range of about 2 to about 200, typically about 2 to about 20 or about 3 to about 20, more typically about 2 to about 10 or about 2 to about 5, where $x_1 \geq 1$ and $y_1 \geq 1$.

Step b): Amination

Amination of the alkoxylated 1,3-diols produces structures represented by Formula I or Formula II:

Formula I

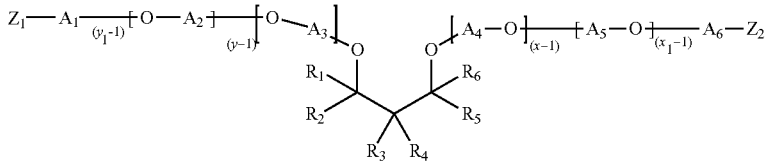

Formula (II)

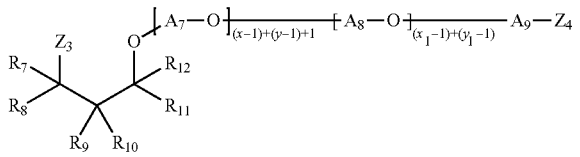

where each of $R_1$-$R_{12}$ is independently selected from H, alkyl, cycloalkyl, aryl, alkylaryl, or arylalkyl, where at least one of $R_1$-$R_6$ and at least one of $R_7$-$R_{12}$ is different from H, each of $A_1$-$A_9$ is independently selected from linear or branched alkylenes having 2 to 18 carbon atoms, typically 2 to 10 carbon atoms, more typically, 2 to 5 carbon atoms, each of $Z_1$-$Z_4$ is independently selected from OH or $NH_2$, where at least one of $Z_1$-$Z_2$ and at least one of $Z_3$-$Z_4$ is $NH_2$, where the sum of x+y is in the range of about 2 to about 200, typically about 2 to about 20 or about 3 to about 20, more typically about 2 to about 10 or about 2 to about 5, where x≥1 and y≥1, and the sum of $x_1+y_1$ is in the range of about 2 to about 200, typically about 2 to about 20 or about 3 to about 20, more typically about 2 to about 10 or about 2 to about 5, where $x_1 \geq 1$ and $y_1 \geq 1$.

Polyetheramines according to Formula I and/or Formula II are obtained by reductive amination of the alkoxylated 1,3-diol mixture (Formula IV and Formula V) with ammonia in the presence of hydrogen and a catalyst containing nickel. Suitable catalysts are described in WO 2011/067199A1, WO2011/067200A1, and EP0696572 B1. Preferred catalysts are supported copper-, nickel-, and cobalt-containing catalysts, where the catalytically active material of the catalyst, before the reduction thereof with hydrogen, comprises oxygen compounds of aluminum, copper, nickel, and cobalt, and, in the range of from about 0.2 to about 5.0% by weight of oxygen compounds, of tin, calculated as SnO. Other suitable catalysts are supported copper-, nickel-, and cobalt-containing catalysts, where the catalytically active material of the catalyst, before the reduction thereof with hydrogen, comprises oxygen compounds of aluminum, copper, nickel, cobalt and tin, and, in the range of from about 0.2 to about 5.0% by weight of oxygen compounds, of yttrium, lanthanum, cerium and/or hafnium, each calculated as $Y_2O_3$, $La_2O_3$, $Ce_2O_3$ and $Hf_2O_3$, respectively. Another suitable catalyst is a zirconium, copper, and nickel catalyst, where the catalytically active composition comprises from about 20 to about 85% by weight of oxygen-containing zirconium compounds, calculated as $ZrO_2$, from about 1 to about 30% by weight of oxygen-containing compounds of copper, calculated as CuO, from about 30 to about 70% by weight of oxygen-containing compounds of nickel, calculated as NiO, from about 0.1 to about 5% by weight of oxygen-containing compounds of aluminium and/or manganese, calculated as $Al_2O_3$ and $MnO_2$ respectively.

For the reductive amination step, a supported as well as non-supported catalyst may be used. The supported catalyst is obtained, for example, by deposition of the metallic components of the catalyst compositions onto support materials known to those skilled in the art, using techniques which are well-known in the art, including without limitation, known forms of alumina, silica, charcoal, carbon, graphite, clays, mordenites; and molecular sieves, to provide supported catalysts as well. When the catalyst is supported, the support particles of the catalyst may have any geometric shape, for example spheres, tablets, or cylinders, in a regular or irregular version. The process may be carried out in a continuous or discontinuous mode, e.g. in an autoclave, tube reactor, or fixed-bed reactor. The feed thereto may be upflowing or downflowing, and design features in the reactor which optimize plug flow in the reactor may be employed. The degree of amination is from about 50% to about 100%, typically from about 60% to about 100%, and more typically from about 70% to about 100%.

The degree of amination is calculated from the total amine value (AZ) divided by sum of the total acetylables value (AC) and tertiary amine value (tert. AZ) multiplied by 100: (Total AZ: (AC+tert. AZ))×100). The total amine value (AZ) is determined according to DIN 16945. The total acetylables value (AC) is determined according to DIN 53240. The secondary and tertiary amine are determined according to ASTM D2074-07.

The hydroxyl value is calculated from (total acetylables value+tertiary amine value)−total amine value.

The polyetheramines of the invention are effective for removal of stains, particularly grease, from soiled material. Cleaning compositions containing the amine-terminated polyalkylene glycols of the invention also do not exhibit the cleaning negatives seen with conventional amine-containing cleaning compositions on hydrophilic bleachable stains, such as coffee, tea, wine, or particulates. Additionally, unlike conventional amine-containing cleaning compositions, the amine-terminated polyalkylene glycols of the invention do not contribute to whiteness negatives on white fabrics.

The polyetheramines of the invention may be used in the form of a water-based, water-containing, or water-free solution, emulsion, gel or paste of the polyetheramine together with an acid such as, for example, citric acid, lactic acid, sulfuric acid, methanesulfonic acid, hydrogen chloride, e.g., aqueous hydrogen chloride, phosphoric acid, or mixtures thereof. Alternatively, the acid may be represented by a surfactant, such as, alkyl benzene sulphonic acid, alkylsulphonic acid, monoalkyl esters of sulphuric acid, mono alkylethoxy esters of sulphuric acid, fatty acids, alkyl ethoxy carboxylic acids, and the like, or mixtures thereof. When applicable or measurable, the preferred pH of the solution or emulsion ranges from pH 3 to pH 11, or from pH 6 to pH 9.5, even more preferred from pH 7 to pH 8.5.

A further advantage of cleaning compositions containing the polyetheramines of the invention is their ability to remove grease stains in cold water, for example, via pretreatment of a grease stain followed by cold water washing. Without being limited by theory, it is believed that cold water washing solutions have the effect of hardening or solidifying grease, making the grease more resistant to removal, especially on fabric. Cleaning compositions containing the polyetheramines of the invention are surprisingly effective when used as part of a pretreatment regimen followed by cold water washing.

Surfactant System

The cleaning compositions comprise a surfactant system in an amount sufficient to provide desired cleaning properties. In some embodiments, the cleaning composition comprises, by weight of the composition, from about 1% to about 70% of a surfactant system. In other embodiments, the liquid cleaning composition comprises, by weight of the composition, from about 2% to about 60% of the surfactant system. In further embodiments, the cleaning composition comprises, by weight of the composition, from about 5% to about 30% of the surfactant system. The surfactant system may comprise a detersive surfactant selected from anionic surfactants, nonionic surfactants, cationic surfactants, zwitterionic surfactants, amphoteric surfactants, ampholytic surfactants, and mixtures thereof. Those of ordinary skill in the art will understand that a detersive surfactant encompasses any surfactant or mixture of surfactants that provide cleaning, stain removing, or laundering benefit to soiled material.

Anionic Surfactants

In some examples, the surfactant system of the cleaning composition may comprise from about 1% to about 70%, by weight of the surfactant system, of one or more anionic surfactants. In other examples, the surfactant system of the cleaning composition may comprise from about 2% to about 60%, by weight of the surfactant system, of one or more anionic surfactants. In further examples, the surfactant system of the cleaning composition may comprise from about 5% to about 30%, by weight of the surfactant system, of one or more anionic surfactants. In further examples, the surfactant system may consist essentially of, or even consist of one or more anionic surfactants.

Specific, non-limiting examples of suitable anionic surfactants include any conventional anionic surfactant. This may include a sulfate detersive surfactant, for e.g., alkoxylated and/or non-alkoxylated alkyl sulfate materials, and/or sulfonic detersive surfactants, e.g., alkyl benzene sulfonates.

Alkoxylated alkyl sulfate materials comprise ethoxylated alkyl sulfate surfactants, also known as alkyl ether sulfates or alkyl polyethoxylate sulfates. Examples of ethoxylated alkyl sulfates include water-soluble salts, particularly the alkali metal, ammonium and alkylolammonium salts, of organic sulfuric reaction products having in their molecular structure an alkyl group containing from about 8 to about 30 carbon atoms and a sulfonic acid and its salts. (Included in the term "alkyl" is the alkyl portion of acyl groups. In some examples, the alkyl group contains from about 15 carbon atoms to about 30 carbon atoms. In other examples, the alkyl ether sulfate surfactant may be a mixture of alkyl ether sulfates, said mixture having an average (arithmetic mean) carbon chain length within the range of about 12 to 30 carbon atoms, and in some examples an average carbon chain length of about 25 carbon atoms, and an average (arithmetic mean) degree of ethoxylation of from about 1 mol to 4 mols of ethylene oxide, and in some examples an average (arithmetic mean) degree of ethoxylation of 1.8 mols of ethylene oxide. In further examples, the alkyl ether sulfate surfactant may have a carbon chain length between about 10 carbon atoms to about 18 carbon atoms, and a degree of ethoxylation of from about 1 to about 6 mols of ethylene oxide.

Non-ethoxylated alkyl sulfates may also be added to the disclosed cleaning compositions and used as an anionic surfactant component. Examples of non-alkoxylated, e.g., non-ethoxylated, alkyl sulfate surfactants include those produced by the sulfation of higher $C_8$-$C_{20}$ fatty alcohols. In some examples, primary alkyl sulfate surfactants have the general formula: $ROSO_3^-M^+$, wherein R is typically a linear $C_8$-$C_{20}$ hydrocarbyl group, which may be straight chain or branched chain, and M is a water-solubilizing cation. In some examples, R is a $C_{10}$-$C_{15}$ alkyl, and M is an alkali metal. In other examples, R is a $C_{12}$-$C_{14}$ alkyl and M is sodium.

Other useful anionic surfactants can include the alkali metal salts of alkyl benzene sulfonates, in which the alkyl group contains from about 9 to about 15 carbon atoms, in straight chain (linear) or branched chain configuration, e.g. those of the type described in U.S. Pat. Nos. 2,220,099 and 2,477,383. In some examples, the alkyl group is linear. Such linear alkylbenzene sulfonates are known as "LAS." In other examples, the linear alkylbenzene sulfonate may have an average number of carbon atoms in the alkyl group of from about 11 to 14. In a specific example, the linear straight chain alkyl benzene sulfonates may have an average number of carbon atoms in the alkyl group of about 11.8 carbon atoms, which may be abbreviated as C11.8 LAS. Such surfactants and their preparation are described for example in U.S. Pat. Nos. 2,220,099 and 2,477,383.

Other anionic surfactants useful herein are the water-soluble salts of: paraffin sulfonates and secondary alkane sulfonates containing from about 8 to about 24 (and in some examples about 12 to 18) carbon atoms; alkyl glyceryl ether sulfonates, especially those ethers of $C_{8-18}$ alcohols (e.g., those derived from tallow and coconut oil). Mixtures of the alkylbenzene sulfonates with the above-described paraffin sulfonates, secondary alkane sulfonates and alkyl glyceryl ether sulfonates are also useful. Further suitable anionic surfactants useful herein may be found in U.S. Pat. No. 4,285,841, Barrat et al., issued Aug. 25, 1981, and in U.S. Pat. No. 3,919,678, Laughlin, et al., issued Dec. 30, 1975, both of which are herein incorporated by reference.

Nonionic Surfactants

The surfactant system of the cleaning composition may comprise a nonionic surfactant. In some examples, the surfactant system comprises up to about 25%, by weight of the surfactant system, of one or more nonionic surfactants, e.g., as a co-surfactant. In some examples, the cleaning compositions comprises from about 0.1% to about 15%, by weight of the surfactant system, of one or more nonionic surfactants. In further examples, the cleaning compositions comprises from about 0.3% to about 10%, by weight of the surfactant system, of one or more nonionic surfactants.

Suitable nonionic surfactants useful herein can comprise any conventional nonionic surfactant. These can include, for e.g., alkoxylated fatty alcohols and amine oxide surfactants. In some examples, the cleaning compositions may contain an ethoxylated nonionic surfactant. These materials are described in U.S. Pat. No. 4,285,841, Barrat et al, issued Aug. 25, 1981. The nonionic surfactant may be selected from the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. In one example, the nonionic surfactant is selected from ethoxylated alcohols having an average of about 24 carbon atoms in the alcohol and an average degree of ethoxylation of about 9 moles of ethylene oxide per mole of alcohol.

Other non-limiting examples of nonionic surfactants useful herein include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1 to 30, as discussed in U.S. Pat. No. 6,153,577, U.S. Pat. No. 6,020,303 and U.S. Pat. No. 6,093,856; Alkylpolysaccharides as discussed in U.S. Pat. No. 4,565,647 to Llenado, issued Jan. 26, 1986; specifically alkylpolyglycosides as discussed in U.S. Pat. No. 4,483,780 and U.S. Pat. No. 4,483,779; Polyhydroxy fatty acid amides as discussed in U.S. Pat. No. 5,332,528, WO 92/06162, WO 93/19146, WO 93/19038, and WO 94/09099; and ether capped poly(oxyalkylated) alcohol surfactants as discussed in U.S. Pat. No. 6,482,994 and WO 01/42408.

Anionic/Nonionic Combinations

The surfactant system may comprise combinations of anionic and nonionic surfactant materials. In some examples, the weight ratio of anionic surfactant to nonionic surfactant is at least about 2:1. In other examples, the weight ratio of anionic surfactant to nonionic surfactant is at least about 5:1. In further examples, the weight ratio of anionic surfactant to nonionic surfactant is at least about 10:1.

Cationic Surfactants

The surfactant system may comprise a cationic surfactant. In some aspects, the surfactant system comprises from about 0% to about 7%, or from about 0.1% to about 5%, or from about 1% to about 4%, by weight of the surfactant system, of a cationic surfactant, e.g., as a co-surfactant. In some aspects, the cleaning compositions of the invention are substantially free of cationic surfactants and surfactants that become cationic below a pH of 7 or below a pH of 6.

Non-limiting examples of cationic include: the quaternary ammonium surfactants, which can have up to 26 carbon atoms include: alkoxylate quaternary ammonium (AQA) surfactants as discussed in U.S. Pat. No. 6,136,769; dimethyl hydroxyethyl quaternary ammonium as discussed in U.S. Pat. No. 6,004,922; dimethyl hydroxyethyl lauryl ammonium chloride; polyamine cationic surfactants as discussed in WO 98/35002, WO 98/35003, WO 98/35004, WO 98/35005, and WO 98/35006; cationic ester surfactants as discussed in U.S. Pat. Nos. 4,228,042, 4,239,660 4,260,529 and U.S. Pat. No. 6,022,844; and amino surfactants as discussed in U.S. Pat. No. 6,221,825 and WO 00/47708, specifically amido propyldimethyl amine (APA).

Zwitterionic Surfactants

Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 at column 19, line 38 through column 22, line 48, for examples of zwitterionic surfactants; betaines, including alkyl dimethyl betaine and cocodimethyl amidopropyl betaine, $C_8$ to $C_{18}$ (for example from $C_{12}$ to $C_{18}$) amine oxides (e.g., $C_{12-14}$ dimethyl amine oxide) and sulfo and hydroxy betaines, such as N-alkyl-N, N-dimethylammino-1-propane sulfonate where the alkyl group can be $C_8$ to $C_{18}$ and in certain embodiments from $C_{10}$ to $C_{14}$.

Ampholytic Surfactants

Specific, non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents may contain at least about 8 carbon atoms, for example from about 8 to about 18 carbon atoms, and at least one contains an anionic water-solubilizing group, e.g. carboxy, sulfonate, sulfate. See U.S. Pat. No. 3,929,678 at column 19, lines 18-35, for suitable examples of ampholytic surfactants.

Amphoteric Surfactants

Examples of amphoteric surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. Examples of compounds falling within this definition are sodium 3-(dodecylamino)propionate, sodium 3-(dodecylamino)propane-1-sulfonate, sodium 2-(dodecylamino)ethyl sulfate, sodium 2-(dimethylamino)octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. See U.S. Pat. No. 3,929,678 to Laughlin et al., issued Dec. 30, 1975 at column 19, lines 18-35, for examples of amphoteric surfactants.

In one aspect, the surfactant system comprises an anionic surfactant and, as a co-surfactant, a nonionic surfactant, for example, a $C_{12}$-$C_{18}$ alkyl ethoxylate. In another aspect, the surfactant system comprises $C_{10}$-$C_{15}$ alkyl benzene sulfonates (LAS) and, as a co-surfactant, an anionic surfactant, e.g., $C_{10}$-$C_{18}$ alkyl alkoxy sulfates ($AE_xS$), where x is from 1-30. In another aspect, the surfactant system comprises an anionic surfactant and, as a co-surfactant, a cationic surfactant, for example, dimethyl hydroxyethyl lauryl ammonium chloride.

Branched Surfactants

Suitable branched detersive surfactants include anionic branched surfactants selected from branched sulphate or branched sulphonate surfactants, e.g., branched alkyl sulphate, branched alkyl alkoxylated sulphate, and branched alkyl benzene sulphonates, comprising one or more random alkyl branches, e.g., $C_{1-4}$ alkyl groups, typically methyl and/or ethyl groups.

In some aspects, the branched detersive surfactant is a mid-chain branched detersive surfactant, typically, a mid-chain branched anionic detersive surfactant, for example, a mid-chain branched alkyl sulphate and/or a mid-chain branched alkyl benzene sulphonate. In some aspects, the detersive surfactant is a mid-chain branched alkyl sulphate. In some aspects, the mid-chain branches are $C_{1-4}$ alkyl groups, typically methyl and/or ethyl groups.

In some aspects, the branched surfactant comprises a longer alkyl chain, mid-chain branched surfactant compound of the formula:

$$A_b\text{-X—B}$$

where:

(a) $A_b$ is a hydrophobic C9 to C22 (total carbons in the moiety), typically from about C12 to about C18, mid-chain branched alkyl moiety having: (1) a longest linear carbon chain attached to the —X—B moiety in the range of from 8 to 21 carbon atoms; (2) one or more C1-C3 alkyl moieties branching from this longest linear carbon chain; (3) at least one of the branching alkyl moieties is attached directly to a carbon of the longest linear carbon chain at a position within the range of position 2 carbon (counting from carbon #1 which is attached to the —X—B moiety) to position ω-2 carbon (the terminal carbon minus 2 carbons, i.e., the third carbon from the end of the longest linear carbon chain); and (4) the surfactant composition has an average total number of carbon atoms in the $A_b$-X moiety in the above formula within the range of greater than 14.5 to about 17.5 (typically from about 15 to about 17);

b) B is a hydrophilic moiety selected from sulfates, sulfonates, amine oxides, polyoxyalkylene (such as polyoxyethylene and polyoxypropylene), alkoxylated sulfates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkylated/polyhydroxyalkylated quats, alkylated/polyhydroxylated oxypropyl quats, imidazolines, 2-yl-succinates, sulfonated alkyl esters, and sulfonated fatty acids (it is to be noted that more than one hydrophobic moiety may be attached to B, for example as in $(A_b\text{-X})_z$—B to give dimethyl quats); and (c) X is selected from —CH2- and —C(O)—.

Generally, in the above formula the $A_b$ moiety does not have any quaternary substituted carbon atoms (i.e., 4 carbon atoms directly attached to one carbon atom). Depending on which hydrophilic moiety (B) is selected, the resultant surfactant may be anionic, nonionic, cationic, zwitterionic, amphoteric, or ampholytic. In some aspects, B is sulfate and the resultant surfactant is anionic.

In some aspects, the branched surfactant comprises a longer alkyl chain, mid-chain branched surfactant compound of the above formula wherein the $A_b$ moiety is a branched primary alkyl moiety having the formula:

$$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_z\text{——}$$

wherein the total number of carbon atoms in the branched primary alkyl moiety of this formula (including the R, $R^1$, and $R^2$ branching) is from 13 to 19; R, R1, and R2 are each independently selected from hydrogen and C1-C3 alkyl (typically methyl), provided R, R1, and R2 are not all hydrogen and, when z is 0, at least R or R1 is not hydrogen; w is an integer from 0 to 13; x is an integer from 0 to 13; y is an integer from 0 to 13; z is an integer from 0 to 13; and w+x+y+z is from 7 to 13.

In certain aspects, the branched surfactant comprises a longer alkyl chain, mid-chain branched surfactant compound of the above formula wherein the $A_b$ moiety is a branched primary alkyl moiety having the formula selected from:

$$CH_3(CH_2)_a\overset{\overset{\displaystyle CH_3}{|}}{C}H(CH_2)_b\text{——}, \quad \text{(I)}$$

$$CH_3(CH_2)_d\overset{\overset{\displaystyle CH_3}{|}}{C}H(CH_2)_e\overset{\overset{\displaystyle CH_3}{|}}{C}H\text{——}, \quad \text{(II)}$$

or mixtures thereof; wherein a, b, d, and e are integers, a+b is from 10 to 16, d+e is from 8 to 14 and wherein further when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when a+b=14, a is an integer from 2 to 13 and b is an integer from 1 to 12;

when a+b=15, a is an integer from 2 to 14 and b is an integer from 1 to 13;

when a+b=16, a is an integer from 2 to 15 and b is an integer from 1 to 14;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9;

when d+e=12, d is an integer from 2 to 11 and e is an integer from 1 to 10;

when d+e=13, d is an integer from 2 to 12 and e is an integer from 1 to 11;

when d+e=14, d is an integer from 2 to 13 and e is an integer from 1 to 12.

In the mid-chain branched surfactant compounds described above, certain points of branching (e.g., the location along the chain of the R, $R^1$, and/or $R^2$ moieties in the above formula) are preferred over other points of branching along the backbone of the surfactant. The formula below illustrates the mid-chain branching range (i.e., where points of branching occur), preferred mid-chain branching range, and more preferred mid-chain branching range for monomethyl branched alkyl $A^b$ moieties.

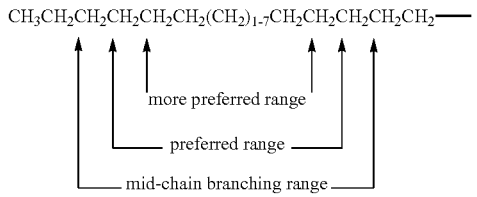

For mono-methyl substituted surfactants, these ranges exclude the two terminal carbon atoms of the chain and the carbon atom immediately adjacent to the —X—B group.

The formula below illustrates the mid-chain branching range, preferred mid-chain branching range, and more preferred mid-chain branching range for di-methyl substituted alkyl $A^b$ moieties.

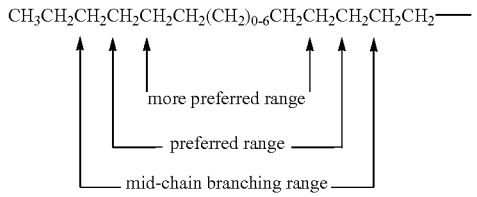

Additional suitable branched surfactants are disclosed in U.S. Pat. No. 6,008,181, U.S. Pat. No. 6,060,443, U.S. Pat. No. 6,020,303, U.S. Pat. No. 6,153,577, U.S. Pat. No. 6,093,856, U.S. Pat. No. 6,015,781, U.S. Pat. No. 6,133,222, U.S. Pat. No. 6,326,348, U.S. Pat. No. 6,482,789, U.S. Pat. No. 6,677,289, U.S. Pat. No. 6,903,059, U.S. Pat. No. 6,660,711, U.S. Pat. No. 6,335,312, and WO 9918929. Yet other suitable branched surfactants include those described in WO9738956, WO9738957, and WO0102451.

In some aspects, the branched anionic surfactant comprises a branched modified alkylbenzene sulfonate (MLAS), as discussed in WO 99/05243, WO 99/05242, WO 99/05244, WO 99/05082, WO 99/05084, WO 99/05241, WO 99/07656, WO 00/23549, and WO 00/23548.

In some aspects, the branched anionic surfactant comprises a C12/13 alcohol-based surfactant comprising a methyl branch randomly distributed along the hydrophobe chain, e.g., Safol®, Marlipal® available from Sasol.

Further suitable branched anionic detersive surfactants include surfactants derived from alcohols branched in the 2-alkyl position, such as those sold under the trade names Isalchem®123, Isalchem®125, Isalchem®145, Isalchem®167, which are derived from the oxo process. Due to the oxo process, the branching is situated in the 2-alkyl position. These 2-alkyl branched alcohols are typically in the range of C11 to C14/C15 in length and comprise structural isomers that are all branched in the 2-alkyl position. These branched alcohols and surfactants are described in US20110033413.

Other suitable branched surfactants include those disclosed in U.S. Pat. No. 6,037,313 (P&G), WO9521233 (P&G), U.S. Pat. No. 3,480,556 (Atlantic Richfield), U.S. Pat. No. 6,683,224 (Cognis), US20030225304A1 (Kao), US2004236158A1 (R&H), U.S. Pat. No. 6,818,700 (Atofina), US2004154640 (Smith et al), EP1280746 (Shell), EP1025839 (L'Oreal), U.S. Pat. No. 6,765,119 (BASF), EP1080084 (Dow), U.S. Pat. No. 6,723,867 (Cognis), EP1401792A1 (Shell), EP1401797A2 (Degussa AG), US2004048766 (Raths et al), U.S. Pat. No. 6,596,675 (L'Oreal), EP1136471 (Kao), EP961765 (Albemarle), U.S. Pat. No. 6,580,009 (BASF), US2003105352 (Dado et al), U.S. Pat. No. 6,573,345 (Cryovac), DE10155520 (BASF), U.S. Pat. No. 6,534,691 (du Pont), U.S. Pat. No. 6,407,279 (Exxon Mobil), U.S. Pat. No. 5,831,134 (Peroxid-Chemie), U.S. Pat. No. 5,811,617 (Amoco), U.S. Pat. No. 5,463,143 (Shell), U.S. Pat. No. 5,304,675 (Mobil), U.S. Pat. No. 5,227,544 (BASF), U.S. Pat. No. 5,446,213A (MITSUBISHI KASEI CORPORATION), EP1230200A2 (BASF), EP1159237B1 (BASF), US20040006250A1 (NONE), EP1230200B1 (BASF), WO2004014826A1 (SHELL), U.S. Pat. No. 6,703,535B2 (CHEVRON), EP1140741B1 (BASF), WO2003095402A1 (OXENO), U.S. Pat. No. 6,765,106B2 (SHELL), US20040167355A1 (NONE), U.S. Pat. No. 6,700,027B1 (CHEVRON), US20040242946A1 (NONE), WO2005037751A2 (SHELL), WO2005037752A1 (SHELL), U.S. Pat. No. 6,906,230B1 (BASF), WO2005037747A2 (SHELL) OIL COMPANY.

Additional suitable branched anionic detersive surfactants include surfactant derivatives of isoprenoid-based polybranched detergent alcohols, as described in US 2010/0137649. Isoprenoid-based surfactants and isoprenoid derivatives are also described in the book entitled "Comprehensive Natural Products Chemistry: Isoprenoids Including Carotenoids and Steroids (Vol. two)", Barton and Nakanishi, ©1999, Elsevier Science Ltd and are included in the structure E, and are hereby incorporated by reference.

Further suitable branched anionic detersive surfactants include those derived from anteiso and iso-alcohols. Such surfactants are disclosed in WO2012009525.

Additional suitable branched anionic detersive surfactants include those described in U.S. patent application Ser. Nos. 2011/0171155A1 and 2011/0166370A1.

Suitable branched anionic surfactants also include Guerbet-alcohol-based surfactants. Guerbet alcohols are branched, primary monofunctional alcohols that have two linear carbon chains with the branch point always at the second carbon position. Guerbet alcohols are chemically described as 2-alkyl-1-alkanols. Guerbet alcohols generally have from 12 carbon atoms to 36 carbon atoms. The Guerbet alcohols may be represented by the following formula: $(R1)(R2)CHCH_2OH$, where R1 is a linear alkyl group, R2 is a linear alkyl group, the sum of the carbon atoms in R1 and R2 is 10 to 34, and both R1 and R2 are present. Guerbet alcohols are commercially available from Sasol as Isofol® alcohols and from Cognis as Guerbetol.

The surfactant system disclosed herein may comprise any of the branched surfactants described above individually or the surfactant system may comprise a mixture of the branched surfactants described above. Furthermore, each of the branched surfactants described above may include a bio-based content. In some aspects, the branched surfactant has a bio-based content of at least about 50%, at least about 60%, at least about 70%, at least about 80%, at least about 90%, at least about 95%, at least about 97%, or about 100%.

Adjunct Cleaning Additives

The cleaning compositions of the invention may also contain adjunct cleaning additives. Suitable adjunct cleaning additives include builders, structurants or thickeners, clay soil removal/anti-redeposition agents, polymeric soil release agents, polymeric dispersing agents, polymeric grease cleaning agents, enzymes, enzyme stabilizing systems, bleaching compounds, bleaching agents, bleach activators, bleach catalysts, brighteners, dyes, hueing agents, dye transfer inhibiting agents, chelating agents, suds supressors, softeners, and perfumes.

Enzymes

The cleaning compositions described herein may comprise one or more enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is an enzyme cocktail that may comprise, for example, a protease and lipase in conjunction with amylase. When present in a consumer product, the aforementioned additional enzymes may be present at levels from about 0.00001% to about 2%, from about 0.0001% to about 1% or even from about 0.001% to about 0.5% enzyme protein by weight of the consumer product.

In one aspect preferred enzymes would include a protease. Suitable proteases include metalloproteases and serine proteases, including neutral or alkaline microbial serine proteases, such as subtilisins (EC 3.4.21.62). Suitable proteases include those of animal, vegetable or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii* described in U.S. Pat. No. 6,312,936 B1, U.S. Pat. No. 5,679,630, U.S. Pat. No. 4,760,025, U.S. Pat. No. 7,262,042 and WO09/021867.

(b) trypsin-type or chymotrypsin-type proteases, such as trypsin (e.g., of porcine or bovine origin), including the *Fusarium* protease described in WO 89/06270 and the chymotrypsin proteases derived from *Cellumonas* described in WO 05/052161 and WO 05/052146.

(c) metalloproteases, including those derived from *Bacillus amyloliquefaciens* described in WO 07/044993A2.

Preferred proteases include those derived from *Bacillus gibsonii* or *Bacillus Lentus*.

Suitable commercially available protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, those sold under the tradename Opticlean® and Optimase® by Solvay Enzymes, those available from Henkel/Kemira, namely BLAP (sequence shown in FIG. 29 of U.S. Pat. No. 5,352,604 with the folowing mutations S99D+S101 R+S103A+V104I+G159S, hereinafter referred to as BLAP), BLAP R (BLAP with S3T+V4I+V199M+V205I+L217D), BLAP X (BLAP with S3T+V4I+V205I) and BLAP F49 (BLAP with S3T+V4I+A194P+V199M+V205I+L217D)—all from Henkel/Kemira; and KAP (*Bacillus alkalophilus* subtilisin with mutations A230V+S256G+S259N) from Kao.

Suitable alpha-amylases include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:

26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, preferably that also contain the deletions of D183* and G184*.

(c) variants exhibiting at least 90% identity with SEQ ID No. 4 in WO06/002643, the wild-type enzyme from *Bacillus* SP722, especially variants with deletions in the 183 and 184 positions and variants described in WO 00/60060, which is incorporated herein by reference.

(d) variants exhibiting at least 95% identity with the wild-type enzyme from *Bacillus* sp. 707 (SEQ ID NO:7 in U.S. Pat. No. 6,093,562), especially those comprising one or more of the following mutations M202, M208, S255, R172, and/or M261. Preferably said amylase comprises one or more of M202L, M202V, M202S, M202T, M202I, M202Q, M202W, S255N and/or R172Q. Particularly preferred are those comprising the M202L or M202T mutations.

(e) variants described in WO 09/149130, preferably those exhibiting at least 90% identity with SEQ ID NO: 1 or SEQ ID NO:2 in WO 09/149130, the wild-type enzyme from *Geobacillus Stearophermophilus* or a truncated version thereof.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS®, POWERASE® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). In one aspect, suitable amylases include NATALASE®, STAINZYME® and STAINZYME PLUS® and mixtures thereof.

In one aspect, such enzymes may be selected from the group consisting of: lipases, including "first cycle lipases" such as those described in U.S. Pat. No. 6,939,702 B1 and US PA 2009/0217464. In one aspect, the lipase is a first-wash lipase, preferably a variant of the wild-type lipase from *Thermomyces lanuginosus* comprising one or more of the T231R and N233R mutations. The wild-type sequence is the 269 amino acids (amino acids 23-291) of the Swissprot accession number Swiss-Prot 059952 (derived from *Thermomyces lanuginosus* (*Humicola lanuginosa*)). Preferred lipases would include those sold under the tradenames Lipex® and Lipolex®.

In one aspect, other preferred enzymes include microbial-derived endoglucanases exhibiting endo-beta-1,4-glucanase activity (E.C. 3.2.1.4), including a bacterial polypeptide endogenous to a member of the genus *Bacillus* which has a sequence of at least 90%, 94%, 97% and even 99% identity to the amino acid sequence SEQ ID NO:2 in U.S. Pat. No. 7,141,403B2) and mixtures thereof. Suitable endoglucanases are sold under the tradenames Celluclean® and Whitezyme® (Novozymes A/S, Bagsvaerd, Denmark).

Other preferred enzymes include pectate lyases sold under the tradenames Pectawash®, Pectaway®, Xpect® and mannanases sold under the tradenames Mannaway® (all from Novozymes A/S, Bagsvaerd, Denmark), and Purabrite® (Genencor International Inc., Palo Alto, Calif.).

Enzyme Stabilizing System

The enzyme-containing compositions described herein may optionally comprise from about 0.001% to about 10%, in some examples from about 0.005% to about 8%, and in other examples, from about 0.01% to about 6%, by weight of the composition, of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, chlorine bleach scavengers and mixtures thereof, and are designed to address different stabilization problems depending on the type and physical form of the cleaning composition. See U.S. Pat. No. 4,537,706 for a review of borate stabilizers.

Builders

The cleaning compositions of the present invention may optionally comprise a builder. Built cleaning compositions typically comprise at least about 1% builder, based on the total weight of the composition. Liquid cleaning compositions may comprise up to about 10% builder, and in some examples up to about 8% builder, of the total weight of the composition. Granular cleaning compositions may comprise up to about 30% builder, and in some examples up to about 5% builder, by weight of the composition.

Builders selected from aluminosilicates and silicates assist in controlling mineral hardness in wash water, especially calcium and/or magnesium, or to assist in the removal of particulate soils from surfaces. Suitable builders may be selected from the group consisting of phosphates polyphosphates, especially sodium salts thereof; carbonates, bicarbonates, sesquicarbonates, and carbonate minerals other than sodium carbonate or sesquicarbonate; organic mono-, di-, tri-, and tetracarboxylates, especially water-soluble non-surfactant carboxylates in acid, sodium, potassium or alkanolammonium salt form, as well as oligomeric or water-soluble low molecular weight polymer carboxylates, including aliphatic and aromatic types; and phytic acid. These may be complemented by borates, e.g., for pH-buffering purposes, or by sulfates, especially sodium sulfate and any other fillers or carriers which may be important to the engineering of stable surfactant and/or builder-containing cleaning compositions. Other builders can be selected from the polycarboxylate builders, for example, copolymers of acrylic acid, copolymers of acrylic acid and maleic acid, and copolymers of acrylic acid and/or maleic acid, and other suitable ethylenic monomers with various types of additional functionalities. Also suitable for use as builders herein are synthesized crystalline ion exchange materials or hydrates thereof having chain structure and a composition represented by the following general anhydride form: $x(M_2O).ySiO_2.zM'O$ wherein M is Na and/or K, M' is Ca and/or Mg; y/x is 0.5 to 2.0; and z/x is 0.005 to 1.0 as taught in U.S. Pat. No. 5,427,711.

Structurant/Thickeners i. Di-benzylidene Polyol Acetal Derivative

The fluid detergent composition may comprise from about 0.01% to about 1% by weight of a dibenzylidene polyol acetal derivative (DBPA), or from about 0.05% to about 0.8%, or from about 0.1% to about 0.6%, or even from about 0.3% to about 0.5%. Non-limiting examples of suitable DBPA molecules are disclosed in U.S. 61/167,604. In one aspect, the DBPA derivative may comprise a dibenzylidene sorbitol acetal derivative (DBS). Said DBS derivative may be selected from the group consisting of: 1,3:2,4-dibenzylidene sorbitol; 1,3:2,4-di(p-methylbenzylidene)sorbitol; 1,3:2,4-di(p-chlorobenzylidene) sorbitol; 1,3:2,4-di(2,4-dimethyldibenzylidene)sorbitol; 1,3:2,4-di(p-ethylbenzylidene)sorbitol; and 1,3:2,4-di(3,4-dimethyldibenzylidene)sorbitol or mixtures thereof. These and other suitable DBS derivatives are disclosed in U.S. Pat. No. 6,102,999, column 2 line 43 to column 3 line 65.

ii. Bacterial Cellulose

The fluid detergent composition may also comprise from about 0.005% to about 1% by weight of a bacterial cellulose network. The term "bacterial cellulose" encompasses any type of cellulose produced via fermentation of a bacteria of the genus *Acetobacter* such as CELLULON® by CPKelco U.S. and includes materials referred to popularly as microfibrillated cellulose, reticulated bacterial cellulose, and the like. Some examples of suitable bacterial cellulose can be found in U.S. Pat. No. 6,967,027; U.S. Pat. No. 5,207,826; U.S. Pat. No. 4,487,634; U.S. Pat. No. 4,373,702; U.S. Pat. No. 4,863,565 and US 2007/0027108. In one aspect, said fibres have cross sectional dimensions of 1.6 nm to 3.2 nm by 5.8 nm to 133 nm. Additionally, the bacterial cellulose fibres have an average microfibre length of at least about 100 nm, or from about 100 to about 1,500 nm. In one aspect, the bacterial cellulose microfibres have an aspect ratio, meaning the average microfibre length divided by the widest cross sectional microfibre width, of from about 100:1 to about 400:1, or even from about 200:1 to about 300:1.

iii. Coated Bacterial Cellulose

In one aspect, the bacterial cellulose is at least partially coated with a polymeric thickener. The at least partially coated bacterial cellulose can be prepared in accordance with the methods disclosed in US 2007/0027108 paragraphs 8 to 19. In one aspect the at least partially coated bacterial cellulose comprises from about 0.1% to about 5%, or even from about 0.5% to about 3%, by weight of bacterial cellulose; and from about 10% to about 90% by weight of the polymeric thickener. Suitable bacterial cellulose may include the bacterial cellulose described above and suitable polymeric thickeners include: carboxymethylcellulose, cationic hydroxymethylcellulose, and mixtures thereof.

iv. Cellulose Fibers Non-Bacterial Cellulose Derived

In one aspect, the composition may further comprise from about 0.01 to about 5% by weight of the composition of a cellulosic fiber. Said cellulosic fiber may be extracted from vegetables, fruits or wood. Commercially available examples are Avicel® from FMC, Citri-Fi from Fiberstar or Betafib from Cosun.

v. Non-Polymeric Crystalline Hydroxyl-Functional Materials

In one aspect, the composition may further comprise from about 0.01 to about 1% by weight of the composition of a non-polymeric crystalline, hydroxyl functional structurant. Said non-polymeric crystalline, hydroxyl functional structurants generally may comprise a crystallizable glyceride which can be pre-emulsified to aid dispersion into the final fluid detergent composition. In one aspect, crystallizable glycerides may include hydrogenated castor oil or "HCO" or derivatives thereof, provided that it is capable of crystallizing in the liquid detergent composition.

vi. Polymeric Structuring Agents

Fluid detergent compositions of the present invention may comprise from about 0.01% to about 5% by weight of a naturally derived and/or synthetic polymeric structurant. Examples of naturally derived polymeric structurants of use in the present invention include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Examples of synthetic polymeric structurants of use in the present invention include: polycarboxylates, polyacrylates, hydrophobically modified ethoxylated urethanes, hydrophobically modified non-ionic polyols and mixtures thereof. In one aspect, said polycarboxylate polymer is a polyacrylate, polymethacrylate or mixtures thereof. In another aspect, the polyacrylate is a copolymer of unsaturated mono- or di-carbonic acid and $C_1$-$C_{30}$ alkyl ester of the (meth)acrylic acid. Said copolymers are available from Noveon inc under the tradename Carbopol Aqua 30.

vii. Di-amido-gellants

In one aspect, the external structuring system may comprise a di-amido gellant having a molecular weight from about 150 g/mol to about 1,500 g/mol, or even from about 500 g/mol to about 900 g/mol. Such di-amido gellants may comprise at least two nitrogen atoms, wherein at least two of said nitrogen atoms form amido functional substitution groups. In one aspect, the amido groups are different. In another aspect, the amido functional groups are the same. The di-amido gellant has the following formula:

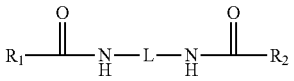

wherein:

$R_1$ and $R_2$ is an amino functional end-group, or even amido functional end-group, in one aspect $R_1$ and $R_2$ may comprise a pH-tuneable group, wherein the pH tuneable amido-gellant may have a pKa of from about 1 to about 30, or even from about 2 to about 10. In one aspect, the pH tuneable group may comprise a pyridine. In one aspect, $R_1$ and $R_2$ may be different. In another aspect, may be the same.

L is a linking moeity of molecular weight from 14 to 500 g/mol. In one aspect, L may comprise a carbon chain comprising between 2 and 20 carbon atoms. In another aspect, L may comprise a pH-tuneable group. In one aspect, the pH tuneable group is a secondary amine.

In one aspect, at least one of $R_1$, $R_2$ or L may comprise a pH-tuneable group.

Non-limiting examples of di-amido gellants are:

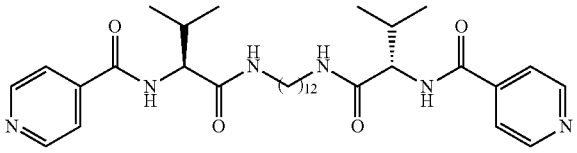

N,N′-(2S,2′S)-1,1′-(dodecane-1,12-diylbis(azanediyl))bis(3-methyl-1-oxobutane-2,1-diyl)diisonicotinamide

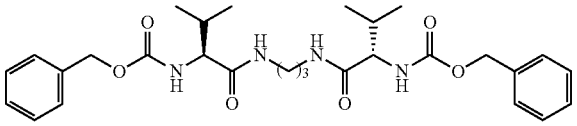

dibenzyl (2S,2′S)-1,1′-(propane-1,3-diylbis(azanediyl))bis(3-methyl-1-oxobutane-2,1-diyl)dicarbamate

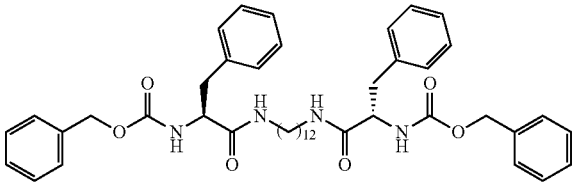

dibenzyl (2S,2′S)-1,1′-(dodecane-1,12-diylbis(azanediyl))bis(1-oxo-3-phenylpropane-2,1-diyl)dicarbamate Polymeric Dispersing Agents The consumer product may comprise one or more polymers. Examples are carboxymethylcellulose, poly(vinylpyrrolidone), poly (ethylene glycol), poly(vinyl alcohol), poly(vinylpyridine-N-oxide), poly(vinylimidazole), polycarboxylates such as polyacrylates, maleic/acrylic acid copolymers and lauryl methacrylate/acrylic acid co-polymers.

The consumer product may comprise one or more amphiphilic cleaning polymers such as the compound having the following general structure: bis($(C_2H_5O)(C_2H_4O)n)CH_3$)—$N^+$—$C_xH_{2x}$—$N^+$—$(CH_3)$-bis($(C_2H_5O)(C_2H_4O)n$), wherein n=from 20 to 30, and x=from 3 to 8, or sulphated or sulphonated variants thereof.

The consumer product may comprise amphiphilic alkoxylated grease cleaning polymers which have balanced hydrophilic and hydrophobic properties such that they remove grease particles from fabrics and surfaces. Specific embodiments of the amphiphilic alkoxylated grease cleaning polymers of the present invention comprise a core structure and a plurality of alkoxylate groups attached to that core structure. These may comprise alkoxylated polyalkylenimines, preferably having an inner polyethylene oxide block and an outer polypropylene oxide block.

Carboxylate polymer—The consumer products of the present invention may also include one or more carboxylate polymers such as a maleate/acrylate random copolymer or polyacrylate homopolymer. In one aspect, the carboxylate polymer is a polyacrylate homopolymer having a molecular weight of from 4,000 Da to 9,000 Da, or from 6,000 Da to 9,000 Da.

Additional Amines

Additional amines may be used in the cleaning compositions described herein for added removal of grease and particulates from soiled materials. The cleaning compositions described herein may comprise from about 0.1% to about 10%, in some examples, from about 0.1% to about 4%, and in other examples, from about 0.1% to about 2%, by weight of the cleaning composition, of additional amines. Non-limiting examples of additional amines may include, but are not limited to, polyamines, oligoamines, triamines, diamines, pentamines, tetraamines, or combinations thereof. Specific examples of suitable additional amines include tetraethylenepentamine, triethylenetetraamine, diethylenetriamine, or a mixture thereof For example, alkoxylated polyamines may be used for grease and particulate removal. Such compounds may include, but are not limited to, ethoxylated polyethyleneimine, ethoxylated hexamethylene diamine, and sulfated versions thereof. Polypropoxylated derivatives may also be included. A wide variety of amines and polyaklyeneimines can be alkoxylated to various degrees. A useful example is 600 g/mol polyethyleneimine core ethoxylated to 20 EO groups per NH and is available from BASF. The cleaning compositions described herein may comprise from about 0.1% to about 10%, and in some examples, from about 0.1% to about 8%, and in other examples, from about 0.1% to about 6%, by weight of the cleaning composition, of alkoxylated polyamines.

Alkoxylated polycarboxylates may also be used in the cleaning compositions herein to provide grease removal. Such materials are described in WO 91/08281 and PCT 90/01815. Chemically, these materials comprise polyacrylates having one ethoxy side-chain per every 7-8 acrylate units. The side-chains are of the formula $—(CH_2CH_2O)_m(CH_2)_nCH_3$ wherein m is 2-3 and n is 6-12. The side-chains are ester-linked to the polyacrylate "backbone" to provide a "comb" polymer type structure. The molecular weight can vary, but may be in the range of about 2000 to about 50,000. The cleaning compositions described herein may comprise from about 0.1% to about 10%, and in some examples, from about 0.25% to about 5%, and in other examples, from about 0.3% to about 2%, by weight of the cleaning composition, of alkoxylated polycarboxylates.

Bleaching Compounds, Bleaching Agents, Bleach Activators, and Bleach Catalysts

The cleaning compositions described herein may contain bleaching agents or bleaching compositions containing a bleaching agent and one or more bleach activators. Bleaching agents may be present at levels of from about 1% to about 30%, and in some examples from about 5% to about 20%, based on the total weight of the composition. If present, the amount of bleach activator may be from about 0.1% to about 60%, and in some examples from about 0.5% to about 40%, of the bleaching composition comprising the bleaching agent plus bleach activator.

Examples of bleaching agents include oxygen bleach, perborate bleach, percarboxylic acid bleach and salts thereof, peroxygen bleach, persulfate bleach, percarbonate bleach, and mixtures thereof. Examples of bleaching agents are disclosed in U.S. Pat. No. 4,483,781, U.S. patent application Ser. No. 740,446, European Patent Application 0,133,354, U.S. Pat. No. 4,412,934, and U.S. Pat. No. 4,634,551.

Examples of bleach activators (e.g., acyl lactam activators) are disclosed in U.S. Pat. Nos. 4,915,854; 4,412,934; 4,634,551; 4,634,551; and 4,966,723.

In some examples, cleaning compositions may also include a transition metal bleach catalyst. In other examples, the transition metal bleach catalyst may be encapsulated. The transition metal bleach catalyst may comprise a transition metal ion, which may be selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV). The transition metal bleach catalyst may comprise a ligand, such as a macropolycyclic ligand or a cross-bridged macropolycyclic ligand. The transition metal ion may be coordinated with the ligand. The ligand may comprise at least four donor atoms, at least two of which are bridgehead donor atoms. Suitable transition metal bleach catalysts are described in U.S. Pat. No. 5,580,485, U.S. Pat. No. 4,430,243; U.S. Pat. No. 4,728,455; U.S. Pat. No. 5,246,621; U.S. Pat. No. 5,244,594; U.S. Pat. No. 5,284,944; U.S. Pat. No. 5,194,416; U.S. Pat. No. 5,246,612; U.S. Pat. No. 5,256,779; U.S. Pat. No. 5,280,117; U.S. Pat. No. 5,274,147; U.S. Pat. No. 5,153,161; U.S. Pat. No. 5,227,084; U.S. Pat. No. 5,114,606; U.S. Pat. No. 5,114,611, EP 549,271 A1; EP 544,490 A1; EP 549,272 A1; and EP 544,440 A2. Another suitable transition metal bleach catalyst is a manganese-based catalyst, as is disclosed in U.S. Pat. No. 5,576,282. Suitable cobalt bleach catalysts are described, for example, in U.S. Pat. No. 5,597,936 and U.S. Pat. No. 5,595,967. Such cobalt catalysts are readily prepared by known procedures, such as taught for example in U.S. Pat. No. 5,597,936, and U.S. Pat. No. 5,595,967. A suitable transition metal bleach catalyst is a transition metal complex of ligand such as bispidones described in WO 05/042532 A1.

Bleaching agents other than oxygen bleaching agents are also known in the art and can be utilized in cleaning compositions. They include, for example, photoactivated bleaching agents such as the sulfonated zinc and/or aluminum phthalocyanines described in U.S. Pat. No. 4,033,718, or pre-formed organic peracids, such as peroxycarboxylic acid or salt thereof, or a peroxysulphonic acid or salt thereof. A suitable organic peracid is phthaloylimidoperoxycaproic acid. If used, the cleaning compositions described herein will typically contain from about 0.025% to about 1.25%, by weight of the composition, of such bleaches, and in some examples, of sulfonate zinc phthalocyanine.

Brighteners

Optical brighteners or other brightening or whitening agents may be incorporated at levels of from about 0.01% to about 1.2%, by weight of the composition, into the cleaning compositions described herein. Commercial optical brighteners, which may be used herein, can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents," M. Zahradnik, John Wiley & Sons, New York (1982). Specific, non-limiting examples of optical brighteners which may be useful in the present compositions are those identified in U.S. Pat. No. 4,790,856 and U.S. Pat. No. 3,646,015.

Fabric Hueing Agents

The compositions may comprise a fabric hueing agent (sometimes referred to as shading, bluing or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Suitable fabric hueing agents include dyes, dye-clay conjugates, and organic and inorganic pigments. Suitable dyes include small molecule dyes and polymeric dyes. Suitable small molecule dyes include small molecule dyes selected from the group consisting of dyes falling into the Colour Index (C.I.) classifications of Direct, Basic, Reactive or hydrolysed Reactive, Solvent or Disperse dyes for example that are classified as Blue, Violet, Red, Green or Black, and provide the desired shade either alone or in combination. In another aspect, suitable small molecule dyes include small molecule dyes selected from the group consisting of Colour Index (Society of Dyers and Colourists, Bradford, UK) numbers Direct Violet dyes such as 9, 35, 48, 51, 66, and 99, Direct Blue dyes such as 1, 71, 80 and 279, Acid Red dyes such as 17, 73, 52, 88 and 150, Acid Violet dyes such as 15, 17, 24, 43, 49 and 50, Acid Blue dyes such as 15, 17, 25, 29, 40, 45, 75, 80, 83, 90 and 113, Acid Black dyes such as 1, Basic Violet dyes such as 1, 3, 4, 10 and 35, Basic Blue dyes such as 3, 16, 22, 47, 66, 75 and 159, Disperse or Solvent dyes such as those described in EP1794275 or EP1794276, or dyes as disclosed in U.S. Pat. No. 7,208,459 B2, and mixtures thereof. In another aspect, suitable small molecule dyes include small molecule dyes selected from the group consisting of C. I. numbers Acid Violet 17, Direct Blue 71, Direct Violet 51, Direct Blue 1, Acid Red 88, Acid Red 150, Acid Blue 29, Acid Blue 113 or mixtures thereof.

Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Polymeric dyes include those described in WO2011/98355, WO2011/47987, US2012/090102, WO2010/145887, WO2006/055787 and WO2010/142503. In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® Violet CT, carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenylmethane polymeric colourants, alkoxylated thiophene polymeric colourants, and mixtures thereof.

Preferred hueing dyes include the whitening agents found in WO 08/87497 A1, WO2011/011799 and WO2012/054835. Preferred hueing agents for use in the present invention may be the preferred dyes disclosed in these references, including those selected from Examples 1-42 in Table 5 of WO2011/011799. Other preferred dyes are disclosed in U.S. Pat. No. 8,138,222. Other preferred dyes are disclosed in WO2009/069077.

Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof.

In another aspect, suitable pigments include pigments selected from the group consisting of Ultramarine Blue (C.I. Pigment Blue 29), Ultramarine Violet (C.I. Pigment Violet 15) and mixtures thereof.

The aforementioned fabric hueing agents can be used in combination (any mixture of fabric hueing agents can be used).

Dye Transfer Inhibiting Agents

Fabric cleaning compositions may also include one or more materials effective for inhibiting the transfer of dyes from one fabric to another during the cleaning process. Generally, such dye transfer inhibiting agents may include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents may be used at a concentration of about 0.01% to about 10%, by weight of the composition, in some examples, from about 0.01% to about 5%, by weight of the composition, and in other examples, from about 0.05% to about 2% by weight of the composition.

Chelating Agents

The cleaning compositions described herein may also contain one or more metal ion chelating agents. Such chelating agents can be selected from the group consisting of phosphonates, amino carboxylates, amino phosphonates, polyfunctionally-substituted aromatic chelating agents and mixtures therein. These chelating agents may be used at a concentration of about 0.1% to about 15% by weight of the cleaning composition, in some examples, from about 0.1% to about 3.0% by weight of the cleaning compositions.

The chelant or combination of chelants may be chosen by one skilled in the art to provide for heavy metal (e.g., Fe) sequestration without negatively impacting enzyme stability through the excessive binding of calcium ions. Non-limiting examples of chelants of use in the present invention are found in U.S. Pat. No. 7,445,644, U.S. Pat. No. 7,585,376 and U.S. Publication 2009/0176684A1.

Examples of useful chelants may include heavy metal chelating agents, such as diethylenetriaminepentaacetic acid (DTPA) and/or a catechol including, but not limited to, Tiron. In embodiments in which a dual chelant system is used, the chelants may be DTPA and Tiron.

DTPA has the following core molecular structure:

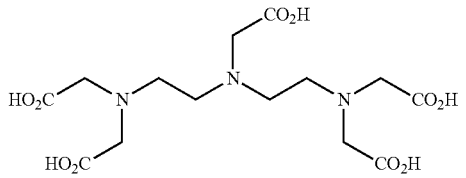

Tiron, also known as 1,2-diydroxybenzene-3,5-disulfonic acid, is one member of the catechol family and has the core molecular structure shown below:

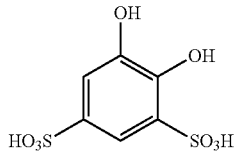

Other sulphonated catechols may also be used. In addition to the disulfonic acid, the term "tiron" may also include mono- or di-sulfonate salts of the acid, such as, for example, the disodium sulfonate salt, which shares the same core molecular structure with the disulfonic acid.

Other chelating agents suitable for use herein can be selected from the group consisting of aminocarboxylates, aminophosphonates, polyfunctionally-substituted aromatic chelating agents, and mixtures thereof. Chelants may also include: HEDP (hydroxyethanediphosphonic acid), MGDA (methylglycinediacetic acid), and mixtures thereof. Other suitable chelating agents are the commercial DEQUEST series, and chelants from Monsanto, DuPont, and Nalco, Inc.

Aminocarboxylates useful as chelating agents include, but are not limited to, ethylenediaminetetracetates, N-(hydroxyethyl)ethylenediaminetriacetates, nitrilotriacetates, ethylenediamine tetraproprionates, triethylenetetraaminehexacetates, diethylenetriamine-pentaacetates, and ethanoldiglycines, alkali metal, ammonium, and substituted ammonium salts thereof, and mixtures thereof. Aminophosphonates are also suitable for use as chelating agents in the compositions of the invention when low levels of total phosphorus are permitted, and include ethylenediaminetetrakis(methylenephosphonates). Preferably, these aminophosphonates do not contain alkyl or alkenyl groups with more than about 6 carbon atoms. Polyfunctionally-substituted aromatic chelating agents may also be used in the cleaning compositions. See U.S. Pat. No. 3,812,044, issued May 21, 1974, to Connor et al. Compounds of this type in acid form are dihydroxydisulfobenzenes, such as 1,2-dihydroxy-3,5-disulfobenzene.

A biodegradable chelator that may also be used herein is ethylenediamine disuccinate ("EDDS"). In some examples, but of course not limited to this particular example, the [S,S] isomer as described in U.S. Pat. No. 4,704,233 may be used. In other examples, the trisodium salt of EDDA may be used, though other forms, such as magnesium salts, may also be useful.

Suds Suppressors

Compounds for reducing or suppressing the formation of suds can be incorporated into the cleaning compositions described herein. Suds suppression can be of particular importance in the so-called "high concentration cleaning process" as described in U.S. Pat. Nos. 4,489,455, 4,489,574, and in front-loading style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430-447 (John Wiley & Sons, Inc., 1979). Examples of suds supressors include monocarboxylic fatty acid and soluble salts therein, high molecular weight hydrocarbons such as paraffin, fatty acid esters (e.g., fatty acid triglycerides), fatty acid esters of monovalent alcohols, aliphatic $C_{18}$-$C_{40}$ ketones (e.g., stearone), N-alkylated amino triazines, waxy hydrocarbons preferably having a melting point below about 100° C., silicone suds suppressors, and secondary alcohols. Suds supressors are described in U.S. Pat. Nos. 2,954,347; 4,265,779; 4,265,779; 3,455,839; 3,933,672; 4,652,392; 4,978,471; 4,983,316; 5,288,431; 4,639,489; 4,749,740; and 4,798,679; 4,075,118; European Patent Application No. 89307851.9; EP 150,872; and DOS 2,124,526.

The cleaning compositions herein may comprise from 0% to about 10%, by weight of the composition, of suds suppressor. When utilized as suds suppressors, monocarboxylic fatty acids, and salts thereof, may be present in amounts of up to about 5% by weight of the cleaning composition, and in some examples, from about 0.5% to about 3% by weight of the cleaning composition. Silicone suds suppressors may be utilized in amounts of up to about 2.0% by weight of the cleaning composition, although higher amounts may be used. Monostearyl phosphate suds suppressors may be utilized in amounts ranging from about 0.1% to about 2% by weight of the cleaning composition. Hydrocarbon suds suppressors may be utilized in amounts ranging from about 0.01% to about 5.0% by weight of the cleaning composition, although higher levels can be used. Alcohol suds suppressors may be used at a concentration ranging from about 0.2% to about 3% by weight of the cleaning composition.

Suds Boosters

If high sudsing is desired, suds boosters such as the $C_{10}$-$C_{16}$ alkanolamides may be incorporated into the cleaning compositions at a concentration ranging from about 1% to about 10% by weight of the cleaning composition. Some examples include the $C_{10}$-$C_{14}$ monoethanol and diethanol amides. If desired, water-soluble magnesium and/or calcium salts such as $MgCl_2$, $MgSO_4$, $CaCl_2$, $CaSO_4$, and the like, may be added at levels of about 0.1% to about 2% by weight of the cleaning composition, to provide additional suds and to enhance grease removal performance.

Fabric Softeners

Various through-the-wash fabric softeners, including the impalpable smectite clays of U.S. Pat. No. 4,062,647 as well as other softener clays known in the art, may be used at levels of from about 0.5% to about 10% by weight of the composition, to provide fabric softener benefits concurrently with fabric cleaning. Clay softeners can be used in combination with amine and cationic softeners as disclosed, for example, in U.S. Pat. No. 4,375,416, and U.S. Pat. No. 4,291,071. Cationic softeners can also be used without clay softeners.

Encapsulates

The compositions may comprise an encapsulate. In some aspects, the encapsulate comprises a core, a shell having an inner and outer surface, where the shell encapsulates the core.

In certain aspects, the encapsulate comprises a core and a shell, where the core comprises a material selected from perfumes; brighteners; dyes; insect repellants; silicones; waxes; flavors; vitamins; fabric softening agents; skin care agents, e.g., paraffins; enzymes; anti-bacterial agents; bleaches; sensates; or mixtures thereof; and where the shell comprises a material selected from polyethylenes; polyamides; polyvinylalcohols, optionally containing other comonomers; polystyrenes; polyisoprenes; polycarbonates; polyesters; polyacrylates; polyolefins; polysaccharides, e.g., alginate and/or chitosan; gelatin; shellac; epoxy resins; vinyl polymers; water insoluble inorganics; silicone; aminoplasts, or mixtures thereof. In some aspects, where the shell comprises an aminoplast, the aminoplast comprises polyurea, polyurethane, and/or polyureaurethane. The polyurea may comprise polyoxymethyleneurea and/or melamine formaldehyde.

In some aspects, the encapsulate comprises a core, and the core comprises a perfume. In certain aspects, the encapsulate comprises a shell, and the shell comprises melamine formaldehyde and/or cross linked melamine formaldehyde. In some aspects, the encapsulate comprises a core comprising a perfume and a shell comprising melamine formaldehyde and/or cross linked melamine formaldehyde Suitable encapsulates may comprise a core material and a shell, where the shell at least partially surrounds the core material. At least 75%, or at least 85%, or even at least 90% of the encapsulates may have a fracture strength of from about 0.2 MPa to about 10 MPa, from about 0.4 MPa to about 5 MPa, from about 0.6 MPa to about 3.5 MPa, or even from about 0.7 MPa to about 3 MPa; and a benefit agent leakage of from 0% to about 30%, from 0% to about 20%, or even from 0% to about 5%.

In some aspects, at least 75%, 85% or even 90% of said encapsulates may have a particle size of from about 1 microns to about 80 microns, about 5 microns to 60 microns, from about 10 microns to about 50 microns, or even from about 15 microns to about 40 microns.

In some aspects, at least 75%, 85% or even 90% of said encapsulates may have a particle wall thickness of from about 30 nm to about 250 nm, from about 80 nm to about 180 nm, or even from about 100 nm to about 160 nm.

In some aspects, the core of the encapsulate comprises a material selected from a perfume raw material and/or optionally a material selected from vegetable oil, including neat and/or blended vegetable oils including caster oil, coconut oil, cottonseed oil, grape oil, rapeseed, soybean oil, corn oil, palm oil, linseed oil, safflower oil, olive oil, peanut oil, coconut oil, palm kernel oil, castor oil, lemon oil and mixtures thereof; esters of vegetable oils, esters, including dibutyl adipate, dibutyl phthalate, butyl benzyl adipate, benzyl octyl adipate, tricresyl phosphate, trioctyl phosphate and mixtures thereof; straight or branched chain hydrocarbons, including those straight or branched chain hydrocarbons having a boiling point of greater than about 80° C.; partially hydrogenated terphenyls, dialkyl phthalates, alkyl biphenyls, including monoisopropylbiphenyl, alkylated naphthalene, including dipropylnaphthalene, petroleum spirits, including kerosene, mineral oil or mixtures thereof; aromatic solvents, including benzene, toluene or mixtures thereof; silicone oils; or mixtures thereof.

In some aspects, the wall of the encapsulate comprises a suitable resin, such as the reaction product of an aldehyde and an amine. Suitable aldehydes include formaldehyde. Suitable amines include melamine, urea, benzoguanamine, glycoluril, or mixtures thereof. Suitable melamines include methylol melamine, methylated methylol melamine, imino melamine and mixtures thereof. Suitable ureas include, dimethylol urea, methylated dimethylol urea, urea-resorcinol, or mixtures thereof.

In some aspects, suitable formaldehyde scavengers may be employed with the encapsulates, for example, in a capsule slurry and/or added to a composition before, during, or after the encapsulates are added to such composition.

Suitable capsules are disclosed in USPA 2008/0305982 A1; and/or USPA 2009/0247449 A1. Alternatively, suitable capsules can be purchased from Appleton Papers Inc. of Appleton, Wis. USA.

In addition, the materials for making the aforementioned encapsulates can be obtained from Solutia Inc. (St Louis, Mo. U.S.A.), Cytec Industries (West Paterson, N.J. U.S.A.), sigma-Aldrich (St. Louis, Mo. U.S.A.), CP Kelco Corp. of San Diego, Calif., USA; BASF AG of Ludwigshafen, Germany; Rhodia Corp. of Cranbury, N.J., USA; Hercules Corp. of Wilmington, Del., USA; Agrium Inc. of Calgary, Alberta, Canada, ISP of New Jersey U.S.A., Akzo Nobel of Chicago, Ill., USA; Stroever Shellac Bremen of Bremen, Germany; Dow Chemical Company of Midland, Mich., USA; Bayer AG of Leverkusen, Germany; Sigma-Aldrich Corp., St. Louis, Mo., USA.

Perfumes

Perfumes and perfumery ingredients may be used in the cleaning compositions described herein. Non-limiting examples of perfume and perfumery ingredients include, but are not limited to, aldehydes, ketones, esters, and the like. Other examples include various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes may be included at a concentration ranging from about 0.01% to about 2% by weight of the cleaning composition.

Pearlescent Agent

The laundry detergent compositions of the invention may comprise a pearlescent agent. Suitable pearlescent agents include those described in USPN 2008/0234165A1. Non-limiting examples of pearlescent agents include: mica; titanium dioxide coated mica; bismuth oxychloride; fish scales; mono and diesters of alkylene glycol of the formula:

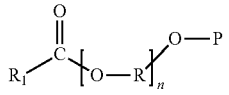

wherein:

a. $R_1$ is linear or branched C12-C22 alkyl group;

b. R is linear or branched C2-C4 alkylene group;

c. P is selected from H; C1-C4 alkyl; or —$COR_2$; and d. n=1-3.

In some aspects, the pearlescent agent is ethyleneglycoldistearate (EGDS).

Fillers and Carriers

Fillers and carriers may be used in the cleaning compositions described herein. As used herein, the terms "filler" and "carrier" have the same meaning and can be used interchangeably.

Liquid cleaning compositions and other forms of cleaning compositions that include a liquid component (such as liquid-containing unit dose cleaning compositions) may contain water and other solvents as fillers or carriers. Low molecular weight primary or secondary alcohols exemplified by methanol, ethanol, propanol, and isopropanol are suitable. Monohydric alcohols may be used in some examples for solubilizing surfactants, and polyols such as those containing from 2 to about 6 carbon atoms and from 2 to about 6 hydroxy groups (e.g., 1,3-propanediol, ethylene glycol, glycerine, and 1,2-propanediol) may also be used. Amine-containing solvents may also be used.

The cleaning compositions may contain from about 5% to about 90%, and in some examples, from about 10% to about 50%, by weight of the composition, of such carriers. For compact or super-compact heavy duty liquid or other forms of cleaning compositions, the use of water may be lower than about 40% by weight of the composition, or lower than about 20%, or lower than about 5%, or less than about 4% free water, or less than about 3% free water, or less than about 2% free water, or substantially free of free water (i.e., anhydrous).

For powder or bar cleaning compositions, or forms that include a solid or powder component (such as powder-containing unit dose cleaning composition), suitable fillers may include, but are not limited to, sodium sulfate, sodium chloride, clay, or other inert solid ingredients. Fillers may also include biomass or decolorized biomass. Fillers in granular, bar, or other solid cleaning compositions may comprise less than about 80% by weight of the cleaning composition, and in some examples, less than about 50% by weight of the cleaning composition. Compact or supercompact powder or solid cleaning compositions may comprise less than about 40% filler by weight of the cleaning composition, or less than about 20%, or less than about 10%.

For either compacted or supercompacted liquid or powder cleaning compositions, or other forms, the level of liquid or solid filler in the product may be reduced, such that either the same amount of active chemistry is delivered to the wash liquor as compared to noncompacted cleaning compositions, or in some examples, the cleaning composition is more efficient such that less active chemistry is delivered to the wash liquor as compared to noncompacted compositions. For example, the wash liquor may be formed by contacting the cleaning composition to water in such an amount so that the concentration of cleaning composition in the wash liquor is from above 0 g/l to 4 g/l. In some examples, the concentration may be from about 1 g/l to about 3.5 g/l, or to about 3.0 g/l, or to about 2.5 g/l, or to about 2.0 g/l, or to about 1.5 g/l, or from about 0 g/l to about 1.0 g/l, or from about 0 g/l to about 0.5 g/l. These dosages are not intended to be limiting, and other dosages may be used that will be apparent to those of ordinary skill in the art.

Buffer System

The cleaning compositions described herein may be formulated such that, during use in aqueous cleaning operations, the wash water will have a pH of between about 7.0 and about 12, and in some examples, between about 7.0 and about 11. Techniques for controlling pH at recommended usage levels include the use of buffers, alkalis, or acids, and are well known to those skilled in the art. These include, but are not limited to, the use of sodium carbonate, citric acid or sodium citrate, monoethanol amine or other amines, boric acid or borates, and other pH-adjusting compounds well known in the art.

The cleaning compositions herein may comprise dynamic in-wash pH profiles. Such cleaning compositions may use wax-covered citric acid particles in conjunction with other pH control agents such that (i) about 3 minutes after contact with water, the pH of the wash liquor is greater than 10; (ii) about 10 minutes after contact with water, the pH of the wash liquor is less than 9.5; (iii) about 20 minutes after contact with water, the pH of the wash liquor is less than 9.0; and (iv) optionally, wherein, the equilibrium pH of the wash liquor is in the range of from about 7.0 to about 8.5.

Other Adjunct Ingredients

A wide variety of other ingredients may be used in the cleaning compositions herein, including other active ingredients, carriers, hydrotropes, processing aids, dyes or pigments, solvents for liquid formulations, and solid or other liquid fillers, erythrosine, colliodal silica, waxes, probiotics, surfactin, aminocellulosic polymers, Zinc Ricinoleate, perfume microcapsules, rhamnolipds, sophorolipids, glycopeptides, methyl ester sulfonates, methyl ester ethoxylates, sulfonated estolides, cleavable surfactants, biopolymers, silicones, modified silicones, aminosilicones, deposition aids, locust bean gum, cationic hydroxyethylcellulose polymers, cationic guars, hydrotropes (especially cumenesulfonate salts, toluenesulfonate salts, xylenesulfonate salts, and naphalene salts), antioxidants, BHT, PVA particle-encapsulated dyes or perfumes, pearlescent agents, effervescent agents, color change systems, silicone polyurethanes, opacifiers, tablet disintegrants, biomass fillers, fast-dry silicones, glycol distearate, hydroxyethylcellulose polymers, hydrophobically modified cellulose polymers or hydroxyethylcellulose polymers, starch perfume encapsulates, emulsified oils, bisphenol antioxidants, microfibrous cellulose structurants, properfumes, styrene/acrylate polymers, triazines, soaps, superoxide dismutase, benzophenone protease inhibitors, functionalized TiO2, dibutyl phosphate, silica perfume capsules, and other adjunct ingredients, diethylenetriaminepentaacetic acid, Tiron (1,2-diydroxybenzene-3,5-disulfonic acid), hydroxyethanedimethylenephosphonic acid, methylglycinediacetic acid, choline oxidase, pectate lyase, triarylmethane blue and violet basic dyes, methine blue and violet basic dyes, anthraquinone blue and violet basic dyes, azo dyes basic blue 16, basic blue 65, basic blue 66 basic blue 67, basic blue 71, basic blue 159, basic violet 19, basic violet 35, basic violet 38, basic violet 48, oxazine dyes, basic blue 3, basic blue 75, basic blue 95, basic blue 122, basic blue 124, basic blue 141, Nile blue A and xanthene dye basic violet 10, an alkoxylated triphenylmethane polymeric colorant; an alkoxylated thiopene polymeric colorant; thiazolium dye, mica, titanium dioxide coated mica, bismuth oxychloride, paraffin waxes, sucrose esters, aesthetic dyes, hydroxamate chelants, and other actives.

The cleaning compositions described herein may also contain vitamins and amino acids such as: water soluble vitamins and their derivatives, water soluble amino acids and their salts and/or derivatives, water insoluble amino acids viscosity modifiers, dyes, nonvolatile solvents or diluents (water soluble and insoluble), pearlescent aids, foam boosters, additional surfactants or nonionic cosurfactants, pediculocides, pH adjusting agents, perfumes, preservatives, chelants, proteins, skin active agents, sunscreens, UV absorbers, vitamins, niacinamide, caffeine, and minoxidil.

The cleaning compositions of the present invention may also contain pigment materials such as nitroso, monoazo, disazo, carotenoid, triphenyl methane, triaryl methane, xanthene, quinoline, oxazine, azine, anthraquinone, indigoid, thionindigoid, quinacridone, phthalocianine, botanical, and natural colors, including water soluble components such as those having C.I. Names. The cleaning compositions of the present invention may also contain antimicrobial agents.

Methods of Use

The present invention includes methods for cleaning soiled material. As will be appreciated by one skilled in the art, the cleaning compositions of the present invention are suited for use in laundry pretreatment applications, laundry cleaning applications, and home care applications.

Such methods include, but are not limited to, the steps of contacting cleaning compositions in neat form or diluted in wash liquor, with at least a portion of a soiled material and then optionally rinsing the soiled material. The soiled material may be subjected to a washing step prior to the optional rinsing step.

For use in laundry pretreatment applications, the method may include contacting the cleaning compositions described herein with soiled fabric. Following pretreatment, the soiled fabric may be laundered in a washing machine or otherwise rinsed.

Machine laundry methods may comprise treating soiled laundry with an aqueous wash solution in a washing machine having dissolved or dispensed therein an effective amount of a machine laundry cleaning composition in accord with the invention. An "effective amount" of the cleaning composition means from about 20 g to about 300 g of product dissolved or dispersed in a wash solution of volume from about 5 L to about 65 L. The water temperatures may range from about 5° C. to about 100° C. The water to soiled material (e.g., fabric) ratio may be from about 1:1 to about 20:1. In the context of a fabric laundry composition, usage levels may also vary depending not only on the type and severity of the soils and stains, but also on the wash water temperature, the volume of wash water, and the type of washing machine (e.g., top-loading, front-loading, top-loading, vertical-axis Japanese-type automatic washing machine).

The cleaning compositions herein may be used for laundering of fabrics at reduced wash temperatures. These methods of laundering fabric comprise the steps of delivering a laundry cleaning composition to water to form a wash liquor and adding a laundering fabric to said wash liquor, wherein the wash liquor has a temperature of from about 0° C. to about 20° C., or from about 0° C. to about 15° C., or from about 0° C. to about 9° C. The fabric may be contacted to the water prior to, or after, or simultaneous with, contacting the laundry cleaning composition with water.

Another method includes contacting a nonwoven substrate impregnated with an embodiment of the cleaning composition with soiled material. As used herein, "nonwoven substrate" can comprise any conventionally fashioned nonwoven sheet or web having suitable basis weight, caliper (thickness), absorbency, and strength characteristics. Non-limiting examples of suitable commercially available nonwoven substrates include those marketed under the tradenames SONTARA® by DuPont and POLYWEB® by James River Corp.

Hand washing/soak methods, and combined handwashing with semi-automatic washing machines, are also included.

Machine Dishwashing Methods

Methods for machine-dishwashing or hand dishwashing soiled dishes, tableware, silverware, or other kitchenware, are included. One method for machine dishwashing comprises treating soiled dishes, tableware, silverware, or other kitchenware with an aqueous liquid having dissolved or dispensed therein an effective amount of a machine dishwashing composition in accord with the invention. By an effective amount of the machine dishwashing composition it is meant from about 8 g to about 60 g of product dissolved or dispersed in a wash solution of volume from about 3 L to about 10 L.

One method for hand dishwashing comprises dissolution of the cleaning composition into a receptacle containing water, followed by contacting soiled dishes, tableware, silverware, or other kitchenware with the dishwashing liquor, then hand scrubbing, wiping, or rinsing the soiled dishes, tableware, silverware, or other kitchenware. Another method for hand dishwashing comprises direct application of the cleaning composition onto soiled dishes, tableware, silverware, or other kitchenware, then hand scrubbing, wiping, or rinsing the soiled dishes, tableware, silverware, or other kitchenware. In some examples, an effective amount of cleaning composition for hand dishwashing is from about 0.5 ml. to about 20 ml. diluted in water.

Packaging for the Compositions

The cleaning compositions described herein can be packaged in any suitable container including those constructed from paper, cardboard, plastic materials, and any suitable laminates. An optional packaging type is described in European Application No. 94921505.7.

Multi-Compartment Pouch Additive

The cleaning compositions described herein may also be packaged as a multi-compartment cleaning composition.

EXAMPLES

In the following examples, the individual ingredients within the cleaning compositions are expressed as percentages by weight of the cleaning compositions.

Synthesis Examples

Example 1

1 mol 2-Butyl-2-ethyl-1,3-propane diol+4 mol propylene oxide/OH, aminated a) 1 mol 2-Butyl-2-ethyl-1,3-propane diol+4 mol propylene oxide/OH In a 2 l autoclave 322.6 g 2-Butyl-2-ethyl-1,3-propane diol and 7.9 g KOH (50% in water) were mixed and stirred under vacuum (<10 mbar) at 120° C. for 2 h. The autoclave was purged with nitrogen and heated to 140° C. 467.8 g propylene oxide was added in portions within 6 h. To complete the reaction, the mixture was allowed to post-react for additional 5 h at 140° C. The reaction mixture was stripped with nitrogen and volatile compounds were removed in vacuo at 80° C. The catalyst potassium hydroxide was removed by adding 2.3 g synthetic magnesium silicate (Macrosorb MP5plus, Ineos Silicas Ltd.), stirring at 100° C. for 2 h and filtration. A yellowish oil was obtained (772.0 g, hydroxy value: 248.5 mg KOH/g).

b) 1 mol 2-Butyl-2-ethyl-1,3-propane diol+4 mol propylene oxide/OH, aminated

In a 9 l autoclave 600 g of the resulting diol mixture from example 1-a, 1250 g THF and 1500 g ammonia were mixed in presence of 200 ml of a solid catalyst as described in EP0696572B1. The catalyst containing nickel, cobalt, copper, molybdenum and zirconium was in the form of 3×3 mm tables. The autoclave was purged with hydrogen and the reaction was started by heating the autoclave. The reaction mixture was stirred for 18 h at 205° C., the total pressure was maintained at 270 bar by purging hydrogen during the entire reductive amination step. After cooling down the autoclave the final product was collected, filtered, vented of excess ammonia and stripped in a rotary evaporator to remove light amines and water. A total of 560 grams of a low-color etheramine mixture was recovered. The analytical results thereof are shown in Table 1.

TABLE 1

| Total amine-value mg KOH/g | Total acetylatables mg KOH/g | Secondary and tertiary amine value mg KOH/g | Tertiary amine-value mg KOH/g | Hydroxyl value mg KOH/g | Degree of amination in % | Primary Amine in % of total amine |
|---|---|---|---|---|---|---|
| 277.66 | 282.50 | 4.54 | 0.86 | 5.70 | 98.59 | 98.36 |

Example 2

Stain Removal from Soluble Unit Dose Laundry Detergent Composition

The following laundry detergent compositions are prepared by traditional means known to those of ordinary skill in the art by mixing the listed ingredients. Composition A is a soluble unit dose laundry detergent composition that contains a soil release polymer (TexCare® SRA-300, supplied by Clariant) and a blocky carboxymethylcellulose (supplied by CP Kelko). Composition B is a soluble unit dose laundry detergent composition that contains a soil release polymer (TexCare® SRA-300, supplied by Clariant), a blocky carboxymethylcellulose (supplied by CP Kelko), and a polyetheramine of Example 1 (see, e.g., Formula B below).

Formula B

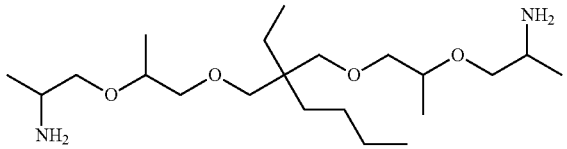

| | Soluble Unit Dose Liquid Detergent A (wt %) | Soluble Unit Dose Liquid Detergent B (wt %) |
|---|---|---|
| Dipropylene Glycol | 7.7 | 7.7 |
| Monopropylene Glycol | 9.6 | 9.6 |
| Glycerin | 10.2 | 10.2 |
| $C_{12-15}$ alkyl ethoxy (1.0) sulfate[17] | 23.8 | 23.8 |
| Acrylic Acid/Maleic Acid Copolymer[2] | 19.0 | 19.0 |
| Amphiphilic polymer[6] | 3.6 | 3.6 |
| AE7[7] | 3.2 | 3.2 |
| Alkyl benzene sulfonate[8] | 6.5 | 6.5 |
| $K_2SO3$ | 1.0 | 1.0 |
| Mg Hydroxyethane di phosphonate[13] | 3.7 | 3.7 |
| Ethoxylated Polyethyleneimine[1] | 2.6 | 2.6 |
| Florescent Whitening Agent 49[10] | 0.34 | 0.34 |
| SRA-300[5] | 0.31 | 0.31 |
| GD 6[14] | 0.40 | 0.40 |
| Polyetheramine[4] | — | 1.82 |
| Citric acid | 0.23 | 0.23 |
| Blocky CMC[3] | 1.12 | 1.12 |
| Protease (40.6 mg active/g)[9] | 1.19 | 1.19 |
| Natalase ® (29.26 mg/g)[11] | 0.12 | 0.12 |
| Termamyl ®Ultra (25.4 mg/g)[15] | 0.12 | 0.12 |
| Mannanase (25 mg/g) - Xyloglucanase (20 mg/g) Blend[12] | 0.26 | 0.26 |

-continued

| | Soluble Unit Dose Liquid Detergent A (wt %) | Soluble Unit Dose Liquid Detergent B (wt %) |
|---|---|---|
| Pectawash ® (20 mg/g)[16] | 0.21 | 0.21 |
| Fragrance | 2.68 | 2.68 |
| Water | Balance to 100% | Balance to 100% |

[1]Polyethyleneimine (MW = 600) with 20 ethoxylate groups per —NH.

[2]Acrylic Acid/Maleic Acid Copolymer has a molecular weight of 70,000 Daltons and an acrylate:maleate ratio of 70:30, supplied by BASF, Ludwigshafen, Germany

[3]Finnfix ® V supplied by CP Kelco, Arnhem, Netherlands

[4]Polyetheramine of Example 1, 1 mol 2-butyl-2-ethyl-1,3-propanediol + 4.0 mol propylene oxide, aminated.

[5]TexCare ® SRA-300, an anionic soil release polymer supplied by Clariant.

[6]Random graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

[7]AE7 is $C_{12-15}$ alcohol ethoxylate, with an average degree of ethoxylation of 7, supplied by Huntsman, Salt Lake City, Utah, USA.

[8]Linear alkylbenzenesulfonate having an average aliphatic carbon chain length $C_{11}$-$C_{12}$ supplied by Stepan, Northfield, Illinois, USA.

[9]Proteases may be supplied by Genencor International, Palo Alto, California, USA (e.g. Purafect Prime ®).

[10]Fluorescent whitening agent 49 supplied by BASF, Ludwigshafen, Germany.

[11]Natalase ® supplied by Novozymes, Bagsvaerd, Denmark.

[12]Mannanase, xyloglucanase blend supplied by Novozymes, Bagsvaerd, Denmark.

[13]Mg Hydroxyethane di phosphonate (HEDP) is supplied by Dow Chemical, Midland, Michigan, USA.

[14]GP-4314 ® silicone suds suppressor supplied by Dow Corning.

[15]Termamyl ®Ultra supplied by Novozymes, Bagsvaerd, Denmark.

[16]Pectawash ® supplied by Novozymes, Bagsvaerd, Denmark.

[17]Ethoxylated alkyl sulfate surfactant with one degree of ethoxylation supplied by Tensachem.

Technical clean knitted cotton, poly-cotton blend, and polyester swatches, supplied by Warwick Equest (County Durham, United Kingdom), were preconditioned prior to staining by washing each swatch four times in laundry detergent composition A or laundry detergent composition B.

In this test, a Whirlpool® Horizontal Axis Duet was used, set for 0° C., 14-minute main wash cycle, using 9 grains per gallon hardness. The total amount of liquid detergent used in each wash cycle was 25 grams. After preconditioning, the technical clean swatches were stained with Black Todd clay, Burnt Beef, Burnt Butter, Chili oil, Curry Blend, Lipstick, and Pork Fat. Eight replicates of each stain type were prepared. The swatches were washed in a Whirlpool® Horizontal Axis Duet washing machine, using 9 grains per gallon water hardness and washed at 20° C. The total amount of liquid detergent used in each cycle was 25 grams. The wash conditions in the Whirlpool® Horizontal Axis Duet require 18-20 liters of water and represent more dilute wash conditions, as compared to a Miele® Horizontal Axis W3622 Appliance (used in Example 3), which requires only 10-12 liters of water.

Standard colorimetric measurement was used to obtain L*, a* and b* values for each stain before and after the washing. From L*, a* and b* values the stain level was calculated. The stain removal index was then calculated according to the SRI formula shown below.

Stain removal from the swatches was measured as follows:

$$\text{Stain Removal Index } (SRI) = \frac{\Delta E_{initial} - E_{washed}}{\Delta E_{initial}} \times 100$$

$\Delta E_{initial}$=Stain level before washing $\Delta E_{washed}$=Stain level after washing The SRI values shown below are the averaged SRI values (average of the eight replicates) for each stain type. The stain level of the fabric before the washing ($\Delta E_{initial}$) is high; in the washing process, stains are removed and the stain level after washing is reduced ($\Delta E_{washed}$). The better a stain has been removed, the lesser the value for $\Delta E_{washed}$ and the greater the difference between $\Delta E_{initial}$ and $\Delta E_{washed}$ ($\Delta E_{initial}-\Delta E_{washed}$). Therefore the value of the stain removal index increases with better washing performance. SRI values in bold represent statistically significant differences in detergent performance.

| | Poly-Cotton | | Polyester | | Knitted Cotton | |
|---|---|---|---|---|---|---|
| Soil | A (SRI) | B (SRI) | A (SRI) | B (SRI) | A (SRI) | B (SRI) |
| Black Todd clay | 74.9 | 73.8 | 79.5 | 84.1 | 56.6 | 54.3 |
| Burnt Beef | 64.6 | 67.8 | 68.8 | 77.5 | 50.6 | 50.2 |
| Burnt Butter | 64.4 | 63.7 | 74.1 | 88.5 | 70.1 | 68.5 |
| Chili oil | 42.7 | 48.1 | 91.3 | 97.3 | 80.4 | 80.8 |
| Curry blend | 43.4 | 45.0 | 88.1 | 95.7 | 37.6 | 32.7 |
| Lipstick | 13.2 | 21.4 | 3.4 | 6.9 | 22.4 | 24.7 |
| Pork fat | 43.4 | 50.1 | 57.6 | 70.2 | 55.8 | 52.6 |

These results illustrate the surprising grease and clay removal benefit of a polyetheramine of the invention when formulated in combination a soil release polymer (TexCare® SRA-300 supplied by Clariant) under the dilute wash conditions of a Whirlpool® Horizontal Axis Duet. Under the dilute wash conditions of a Whirlpool® Horizontal Axis Duet, the combination of TexCare® SRA-300 and the polyetheramine of the invention delivers unexpected benefits on polyester stained with hydrophilic stains, such as Black Todd Clay and cosmetics, e.g., Lipstick. Without being bound by theory, it is believed that the combination of TexCare® SRA-300 and the polyetheramine of the invention creates an improved protective film on polyester and polyester blends, resulting in better overall cleaning on polyester and poly-cotton blends.

Example 3

Stain Removal from Soluble Unit Dose Composition

Technical clean knitted cotton and polyester swatches, supplied by Warwick Equest (County Durham, United Kingdom), were preconditioned prior to staining by washing each swatch four times in laundry detergent composition A or laundry detergent composition B. In this test, a Miele® Horizontal Axis W3622 Appliance was used, set for short wash cycle, 30° C., using 14 grains per gallon hardness. The total amount of liquid detergent used in each wash cycle was 25 grams. After preconditioning, the technical clean swatches were stained with Black Todd clay, Burnt Beef, Burnt Butter, Chili oil, Chocolate Ice Cream, Coffee, Grass, Lipstick, and Tea. The swatches were washed in a Meile® Horizontal Axis W3622 Appliance set for a short wash cycle, using 14 grains per gallon water hardness, at 30° C. The total amount of liquid detergent used in each cycle was 25 grams. The wash conditions in the Miele® Horizontal Axis Appliance require 10-12 liters of water and represent more concentrated wash conditions, as compared to the Whirlpool® Horizontal Axis Duet (used in Example 2), which requires 18-20 liters of water.

Standard colorimetric measurement was used to obtain L*, a* and b* values for each stain before and after the washing. From L*, a* and b* values the stain level was calculated. The stain removal index was then calculated according to the SRI formula shown above. Eight replicates of each stain type were prepared. The SRI values shown below are the averaged SRI values for each stain type.

| | Knitted Cotton | | Polyester | |
|---|---|---|---|---|
| Soil | A (SRI) | B (SRI) | A (SRI) | B (SRI) |
| Black Todd clay | 42.3 | **48.5** | 77.3 | **84.1** |
| Burnt beef | 40.8 | **67.5** | 69.7 | 83.6 |
| Burnt butter | 56.5 | **73.2** | 72.7 | 79 |
| Chocolate ice cream | 86.4 | **90.8** | 97.5 | 97.3 |
| Coffee | 59.5 | **67.2** | 96.2 | 96.1 |
| Grass | 78.4 | **89.2** | 82.1 | 82.6 |
| Lipstick | 25.6 | **33.5** | 10.3 | 16.1 |
| Tea | 39.6 | **47.4** | 51.7 | **72.9** |

These results illustrate the surprising grease, clay, and beverage stain removal benefit of a polyetheramine of the invention when formulated in combination with a soil release polymer (TexCare® SRA-300 supplied by Clariant) and a blocky carboxymethylcellulose (Finnfix® V supplied by CP Kelco) under the concentrated wash conditions of the Miele® Horizontal Axis W3622 Appliance. Under the concentrated wash conditions of the Miele® Horizontal Axis W3622 Appliance, the combination of Finnfix® V and the polyetheramine of the invention delivers unexpected cleaning benefits on knitted cotton stained with hydrophilic stains, such as Coffee, Tea, Chocolate ice cream, Black Todd Clay, and cosmetics, e.g., Lipstick. Also, the combination of TexCare® SRA-300 and the polyetheramine of the invention delivers unexpected benefits on polyester stained with hydrophilic stains, such as Tea and Black Todd Clay. Without being bound by theory, it is believed that the combination of TexCare® SRA-300 and the polyetheramine of the invention creates an improved protective film on polyester and the combination of Finnfix® V and the polyetheramine of the invention creates an improved protective film on knitted cotton.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern."

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning composition comprising:

from about 1% to about 70% by weight of a surfactant system;

from about 0.01% to about 10.0% by weight of a soil release polymer;

from about 0.1% to about 10% of a carboxymethylcellulose; and from about 0.1% to about 10% of a polyetheramine of Formula (I), Formula (II), or a mixture thereof:

Formula (I)

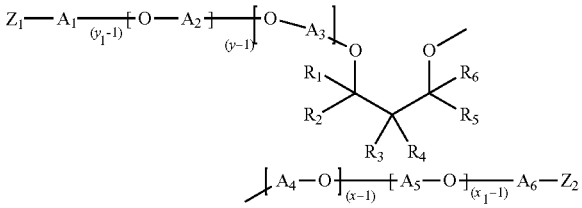

Formula (II)

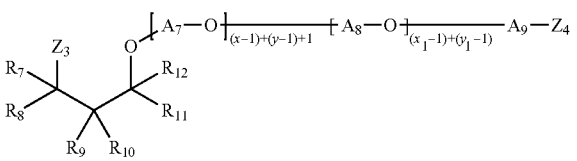

wherein each of $R_1$-$R_{12}$ is independently selected from H, alkyl, cycloalkyl, aryl, alkylaryl, or arylalkyl, wherein at least one of $R_1$-$R_6$ and at least one of $R_7$-$R_{12}$ is different from H, each of $A_1$-$A_9$ is independently selected from linear or branched alkylenes having 2 to 18 carbon atoms, each of $Z_1$-$Z_4$ is independently selected from OH or $NH_2$, wherein at least one of $Z_1$-$Z_2$ and at least one of $Z_3$-$Z_4$ is $NH_2$, wherein the sum of x+y is in the range of about 2 to about 8, wherein $x \geq 1$ and $y \geq 1$, and the sum of $x_1+y_1$ is in the range of about 2 to about 8, wherein $x_1 \geq 1$ and $y_1 \geq 1$.

2. The cleaning composition of claim 1 wherein in said polyetheramine of Formula (I) or Formula (II), each of $Z_1$-$Z_4$ is $NH_2$.

3. The cleaning composition of claim 1 wherein said polyetheramine comprises a polyetheramine mixture comprising at least 90%, by weight of said polyetheramine mixture, of said polyetheramine of Formula (I), said polyetheramine of Formula (II), or a mixture thereof.

4. The cleaning composition of claim 1 wherein in said polyetheramine of Formula (I) or Formula (II), each of $A_1$-$A_9$ is independently selected from ethylene, propylene, or butylene.

5. The cleaning composition of claim 1 wherein in said polyetheramine of Formula (I) or Formula (II), each of $A_1$-$A_9$ is propylene.

6. The cleaning composition of claim 1 wherein in said polyetheramine of Formula (I) or Formula (II), each of $R_1$, $R_2$, $R_5$, $R_6$, $R_7$, $R_8$, $R_{11}$, and $R_{12}$ is H and each of $R_3$, $R_4$, $R_9$, and $R_{10}$ is independently selected from C1-C16 alkyl or aryl.

7. The cleaning composition of claim 1, wherein in said polyetheramine of Formula (I) or Formula (II), each of $R_1$, $R_2$, $R_5$, $R_6$, $R_7$, $R_8$, $R_{11}$, and $R_{12}$ is H and each of $R_3$, $R_4$, $R_9$, and $R_{10}$ is independently selected from a butyl group, an ethyl group, a methyl group, a propyl group, or a phenyl group.

8. The cleaning composition of claim 1, wherein in said polyetheramine of Formula (I) or Formula (II), each of $R_1$, $R_2$, $R_7$, and $R_8$ is H and each of $R_3$, $R_4$, $R_5$, $R_6$, $R_9$, $R_{10}$, $R_{11}$, and $R_{12}$ is independently selected from an ethyl group, a methyl group, a propyl group, a butyl group, a phenyl group, or H.

9. The cleaning composition of claim 1, wherein in said polyetheramine of Formula (I) or Formula (II), each of $R_3$ and $R_9$ is an ethyl group, each of $R_4$ and $R_{10}$ is a butyl group, and each of $R_1$, $R_2$, $R_5$, $R_6$, $R_7$, $R_8$, $R_{11}$, and $R_{12}$ is H.

10. The cleaning composition of claim 1, wherein said polyetheramine has a weight average molecular weight of about 290 to about 900 grams/mole.

11. The cleaning composition of claim 1, wherein said polyetheramine has a weight average molecular weight of about 300 to about 450 grams/mole.

12. The cleaning composition of claim 1, wherein said polyetheramine has a weight average molecular weight of about 300 to about 700 grams/mole.

13. The cleaning composition of claim 1 further comprising from about 0.001% to about 1% by weight of enzyme.

14. The cleaning composition of claim 1 wherein said enzyme is selected from lipase, amylase, protease, mannanase, or combinations thereof.

15. The cleaning composition of claim 1 wherein said surfactant system comprises one or more surfactants selected from anionic surfactants, cationic surfactants, nonionic surfactants, amphoteric surfactants.

16. The cleaning composition of claim 1 further comprising from about 0.1% to about 10% by weight of an additional amine.

17. The cleaning composition of claim 16 wherein said additional amine is selected from oligoamines, triamines, diamines, or a combination thereof.

18. The cleaning composition of claim 16 wherein said additional amine is selected from tetraethylenepentamine, triethylenetetraamine, diethylenetriamine, or a mixture thereof.

19. A method of pretreating or treating a soiled fabric comprising contacting the soiled fabric with the cleaning composition of claim 1.

* * * * *